US011771224B2

(12) United States Patent
Prentner

(10) Patent No.: US 11,771,224 B2
(45) Date of Patent: Oct. 3, 2023

(54) DRAWER EXTRACTION GUIDE

(71) Applicant: Samet Kalip Ve Maden Esya San. Ve Tic. A.S., Istanbul (TR)

(72) Inventor: Christian Prentner, Altach (AT)

(73) Assignee: Samet Kalip Ve Madeni Esya San. Ve Tic. A.S.

( * ) Notice: Subject to any disclaimer, the term of this patent is extended or adjusted under 35 U.S.C. 154(b) by 136 days.

(21) Appl. No.: 17/298,981

(22) PCT Filed: Dec. 11, 2018

(86) PCT No.: PCT/TR2018/050790
§ 371 (c)(1),
(2) Date: Jun. 2, 2021

(87) PCT Pub. No.: WO2020/122822
PCT Pub. Date: Jun. 18, 2020

(65) Prior Publication Data

US 2022/0061529 A1 Mar. 3, 2022

(51) Int. Cl.
*A47B 88/493* (2017.01)

(52) U.S. Cl.
CPC ..... *A47B 88/493* (2017.01); *A47B 2210/007* (2013.01); *A47B 2210/0008* (2013.01); *A47B 2210/0018* (2013.01)

(58) Field of Classification Search
CPC ..... A47B 88/493; A47B 2210/0008; A47B 2210/007; A47B 2210/0018
See application file for complete search history.

(56) References Cited

U.S. PATENT DOCUMENTS 9,044,088 B2 6/2015 Greussing
9,596,932 B2 3/2017 Greussing
(Continued)

FOREIGN PATENT DOCUMENTS

CN 1768650 A 5/2006
CN 101848662 A 9/2010
(Continued)

OTHER PUBLICATIONS

International Search Report for corresponding patent application No. PCT/TR2018/050790, dated May 11, 2019, 12 pages (not prior art).

(Continued)

*Primary Examiner* — James O Hansen
(74) *Attorney, Agent, or Firm* — Lucian Wayne Beavers; Patterson Intellectual Property Law, PC

(57) ABSTRACT

The invention relates to a drawer extraction guide with a corpus rail, a drawer rail, and a center rail and carriages arranged between them. It is provided that a synchronization device comprises at least a first and a second gear set with one or more synchronization wheels that are coupled with each other; that rolls a first synchronization wheel of the first gear set on one of the rails, on a component attached to the rail, on one of the carriages, or on an element attached to the carriage; that rolls a synchronization wheel of the second gear set on a further rail, on an element attached to a further rail, on a further carriage, or on an element attached to a further carriage; the synchronization device comprising a transfer member that is linearly and freely adjustable relative to the corpus rail, the center rail, the drawer rail, and the gear sets; and that one synchronization wheel of the first and the second gear set each roll on the transfer member. The invention allows for a compact configuration of a drawer extraction guide that is synchronized in its movement.

19 Claims, 9 Drawing Sheets

(56) References Cited

U.S. PATENT DOCUMENTS

Figure 1:
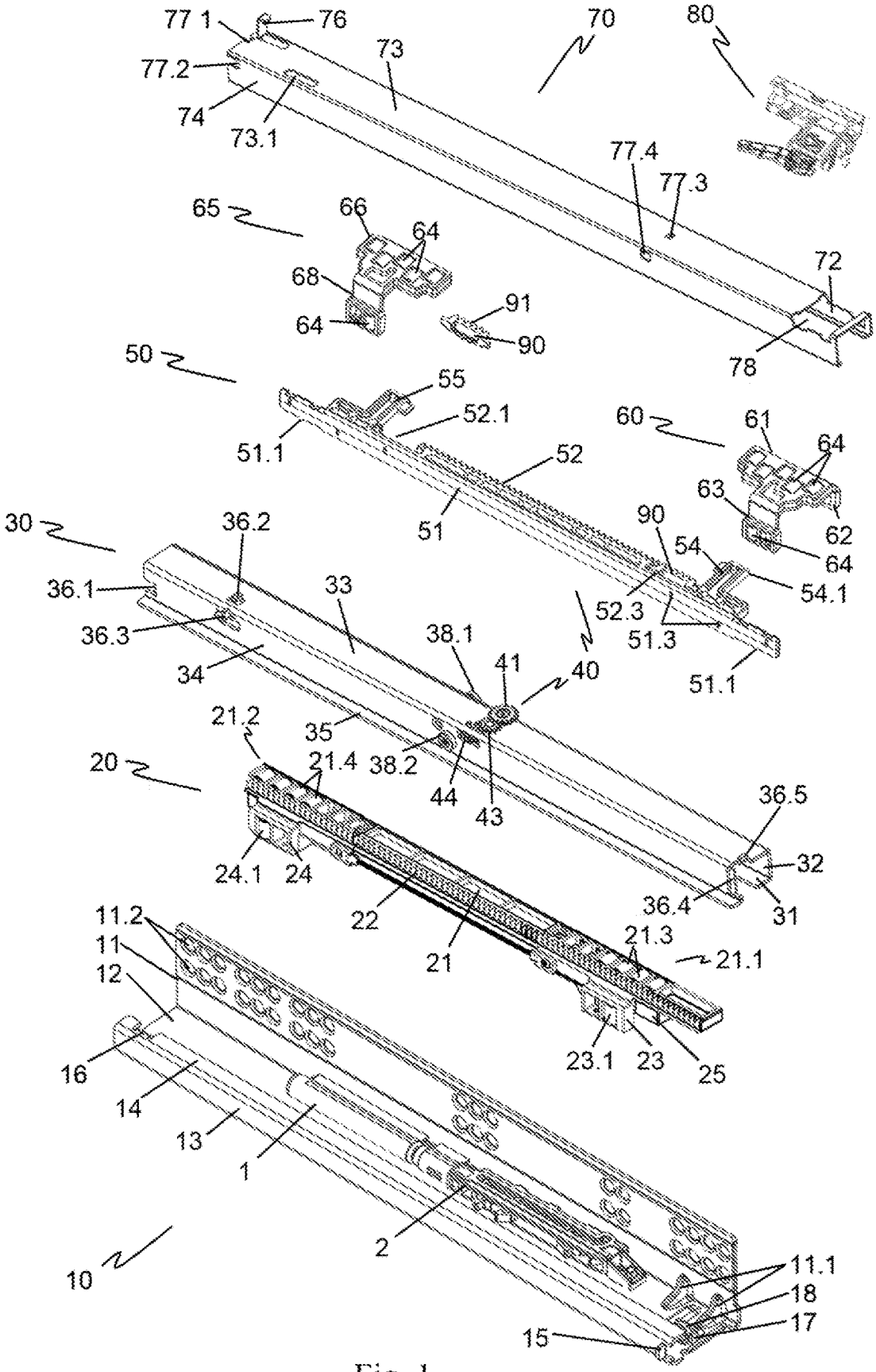

| | | | | |
|---|---|---|---|---|
| 9,642,462 | B2 | 5/2017 | Violand | |
| 9,661,926 | B2 | 5/2017 | Friesenecker et al. | |
| 9,784,314 | B2 * | 10/2017 | Ng | F16C 33/48 |
| 9,993,077 | B2 * | 6/2018 | Chen | A47B 88/447 |
| 10,327,548 | B2 | 6/2019 | Meusburger | |
| 2006/0091770 | A1 | 5/2006 | Ritter et al. | |
| 2013/0002115 | A1 | 1/2013 | Friesenecker et al. | |
| 2013/0127319 | A1 * | 5/2013 | Breisacher | A47B 88/447 312/334.23 |
| 2013/0127320 | A1 * | 5/2013 | Greussing | A47B 88/493 312/334.44 |
| 2016/0128473 | A1 | 5/2016 | Ng | |

FOREIGN PATENT DOCUMENTS

| | | | |
|---|---|---|---|
| CN | 102770047 | A | 11/2012 |
| CN | 103025208 | A | 4/2013 |
| CN | 103027502 | A | 4/2013 |
| CN | 103929999 | A | 7/2014 |
| CN | 204132844 | U | 2/2015 |
| CN | 204132846 | U | 2/2015 |
| CN | 204483536 | U | 7/2015 |
| CN | 105792705 | A | 7/2016 |
| CN | 106724189 | A | 5/2017 |
| CN | 108463141 | A | 8/2018 |
| DE | 102004002823 | A1 | 8/2005 |
| DE | 202015102284 | U1 | 7/2015 |
| EP | 2538818 | A1 | 1/2013 |
| WO | 2009036882 | A2 | 3/2009 |
| WO | 2011103605 | A1 | 9/2011 |

OTHER PUBLICATIONS

China Office Action for corresponding patent application No. 2022050901806170, dated May 12, 2022, 11 pages (not prior art).
China Office Action for corresponding patent application No. 2023042700119060, dated Apr. 27, 2023, 8 pages (not prior art).

* cited by examiner

DRAWER EXTRACTION GUIDE

The invention relates to a drawer extraction guide for supporting a drawer that is linearly movable along an extension direction of the drawer extraction guide in a furniture corpus, with a corpus rail attachable to the furniture corpus, a drawer rail attachable to the drawer, and a linearly movable center rail transmitting force between the corpus rail and the drawer rail, with at least one load-transmitting inner carriage arranged between the corpus rail and the center rail, with at least one load-transmitting outer carriage arranged between the center rail and the drawer rail and with a synchronization device for synchronizing the movement of the center rail with the movement of the drawer rail.

Extraction guides are used to guide extractable furniture parts, for example drawers and the like, in pieces of furniture, on which the furniture part is supported linearly movable in respect to a furniture corpus. For a full extraction, systems with three rails movably supported in respect to each other are known, i.e., a corpus rail attached to the furniture corpus, an extraction or drawer rail attached to the extractable furniture part, and a center rail movably arranged between the corpus rail and the extraction rail. Carriages with suitable rolling elements such as wheels or rollers may be provided between the center rail and the extraction rail, or respectively between the center rail and the corpus rail, on which rolling elements the rails roll in respect to each other when the extractable furniture part is pulled out or pushed in. In order to achieve a reproducible, even movement of the rails in respect to each other, synchronization means are known which act between the rails, a part of the rails, or between a part of the rails and one or more carriages.

A drawer extraction guide for guiding a furniture extraction units with a corpus rail, a center rail, an extraction rail and supporting means (carriages) arranged between the rails is known from WO 2009/036882. A synchronization means interacts with the base bodies of the respective supporting means. Thereby, the synchronization means is preferably embodied as a gear wheel supported at the center rail, which passes through an opening provided in the center rail and opposite thereto meshes with one of toothed racks arranged at the base bodies of the supporting means. The supporting means are therefore moved in opposite directions in respect to the center rail. The movement range of the supporting means is limited by the length of the base bodies and of the toothed racks arranged thereon. It is disadvantageous, therefore, that the base bodies of the supporting means must extend along the entire length of the required movement range. For furniture extraction units with different extraction lengths different supporting means must be provided. Due to the rolling elements arranged thereon, their production is complex and expensive. It is further disadvantageous that the force during opening and closing of, for example, a drawer is introduced by means of the extraction rail, which is connected with another component of the drawer extraction guide only by means of one or more supporting means, but not by means of synchronization means. This may lead to slippage between the rails. It may therefore be necessary to provide an additional synchronization means, for example in the form of a roller supported on the center rail, between the extraction rail and the corpus rail.

EP 2 538 818 B1 describes an extraction guide for drawers with a corpus rail, a center rail, and a drawer rail, whereby at least one carriage is arranged between two rails. A synchronization device, which is also provided, comprises a synchronization wheel formed from two pinion wheels connected to each other in a torque proof manner by means of an axle. The first pinion wheel meshes exclusively with a toothing connected to the carriage, while the second pinion wheel only meshes with a running surface of a rail configured as a toothed rack. This results in a direct coupling of the rail with the carriage. It is disadvantageous that the toothing at the carriage and the toothed rack of the rail must be arranged along the common axle of the pinion wheels, whereby the freedom of design of the extraction guide is significantly limited.

It is an object of the invention to provide a drawer extraction guide with a synchronization device that can be easily adjusted to different extraction lengths of the drawer extraction guide and that has a compact design.

The object of the invention is solved in that the synchronization device comprises at least a first and a second wheel set with one or more synchronization wheels that are coupled with each other, that a first synchronization wheel of the first wheel set rolls on one of the rails, on a component attached to the rail, on one of the carriages, or on a component attached to the carriage, that a synchronization wheel of the second wheel set rolls on a further rail, on a component attached to the further rail, on a further carriage, or on a component attached to the further carriage, that the synchronization device comprises a transfer member that is linearly and freely movable in respect to the corpus rail, the center rail, the drawer rail, and the wheel sets; and that a synchronization wheel of the first and the second wheel set each roll on the transfer member.

A coupling of the synchronization wheels means a connection of two or more synchronization wheels on a common axle or, respectively, an arrangement of two synchronization wheels in such a way that they abut at their circumference and roll on each other. The rotational movement of a synchronization wheel is thereby transferred to the other synchronization wheels of the respective wheel set. The term "rails" is used within the meaning of the invention as a collective term for the corpus rail, the center rail, and the drawer rail.

The first wheel set establishes a synchronized connection to a first rail or a first carriage. During a rotation of a first synchronization wheel that rolls on the rail, the carriage, or a component attached to the rail or the carriage, a linear displacement occurs between the rail or the carriage, respectively, and the first synchronization wheel according to the circular curve at the circumference of the first synchronization wheel run through during its rotation. According to the rotation of the second synchronization wheel of the second wheel set rolling on the further rail, the further carriage, or a component attached to the further rail or the further carriage, a linear displacement occurs between these components corresponding to the circular curve run through by the second synchronization wheel of the second wheel set. The transfer member provides for a mechanical coupling between the first and the second wheel set and therefore between the synchronization wheels rolling indirectly or directly on the rails or the carriages, respectively. The movements of the rail or the carriage, respectively, on which the first synchronization wheel of the first wheel set rolls, and of the rail or the carriage, respectively, on which the second synchronization wheel of the second wheel set rolls, are thereby synchronized. For example, the first synchronization wheel of the first wheel set may roll on the drawer rail and the second synchronization wheel of the second wheel set on the inner carriage or each on a component attached to one of these elements. The movement of the drawer rails and of the inner carriage are thereby mechanically coupled.

The geometry of the transfer member can easily be adapted to the space available in the drawer extraction guide. It may, for example, be arranged between the corpus rail and the center rail or between the center rail and the drawer rail. The length of the transfer member can easily be adapted to the desired extraction length of the drawer extraction guide. Thereby, for example the same carriages can be used for drawer extraction guides with different extraction lengths, while the length of the transfer member is adapted to the respective drawer extraction guide. The transfer member can be manufactured in a simple and cost-efficient manner because it is not intended for the transfer of a load between the rails.

The transfer member, whose form can be freely chosen, may be configured in such a way that with its rolling surfaces, it is guided in respect to the synchronization wheels of the wheel sets that roll thereon. Thereby, the rolling surfaces may have different orientations obliquely in respect to the extraction direction. The synchronization wheels of the two wheel sets may be arranged along differently oriented planes. This way, the synchronization wheels of the wheel sets may be arranged relatively freely and in a space-saving manner within the drawer extraction guide. The positioning and orientation of the synchronization wheels of a wheel set are not tied to the positioning and orientation of the synchronization wheels of the further wheel set. This allows for a simple construction of the drawer extraction guide, in which the wheel sets can be arranged in such a way that their respective synchronization wheel can roll on the corresponding rail or the corresponding carriage and the synchronization wheels do not collide with other components during opening and closing of the drawer extraction guide.

The transfer member is supported in a freely movable manner in respect to the rails and the carriages. Its movement is therefore not directly coupled with the movement of a rail or a carriage. It merely depends on the rotational movement and the linear displacement of the synchronization wheels thereon. The movement of the transfer member must therefore not be adapted to the movement of a rail or a carriage beyond the avoidance of collisions.

A large adjusting range of the transfer member can be achieved by supporting the transfer member in and opposite to the extraction direction of the drawer extraction guide in a linearly movable manner. The longitudinal extension of the drawer extraction guide runs along its extraction direction. It therefore has its greatest length in or opposite to the extraction direction within which the transfer member can move.

It is intended that at least one wheel set comprises two or more synchronization wheels coupled with each other and that the synchronization wheels form a gear mechanism so that different relative speeds between the rails and the carriages can be realized. The speed of the center rail in respect to the corpus rail may, for example, be set faster than the speed of the drawer rail in respect to the center rail. When opening a drawer that is guided by the drawer extraction guide, the center rail is extracted further in respect to the corpus rail than the drawer rail is extracted in respect to the center rail, which creates less pressure on the drawer rail. With an appropriate translation of the gear mechanism or gear mechanisms of the synchronization unit, such different speeds of motion and therefore extraction lengths of the center rail and the drawer rail can be set.

According to a preferred embodiment of the invention, it may be provided that the synchronization wheels are, at least partially, embodied as gearwheels. Then, the wheels or carriages on which a synchronization wheel rolls, are provided with respective toothed racks, with each of which a gearwheel of a wheel set meshes. Compared to synchronization wheels designed as friction wheels, an advantage of gearwheels is that they do not slip. Thereby, the synchronization is maintained even during fast load alternations during the opening and closing of a drawer.

In a particularly preferred embodiment, the synchronization wheels may be rotatably supported at the center rail. Thereby, a positively guided connection between the center rail and the rails or carriages, on each of which a synchronization wheel of the wheel set rolls, is realized. Ultimately, a synchronizing connection is established between three movably supported components, for example the drawer rail, the center rail, and the inner carriage, or between the corpus rail, which, when installed, is fixedly attached to the furniture corpus, and two other movably supported components such as, for example, the center rail and the drawer rail. This guarantees a synchronized movement of the center rail and of the drawer rail.

Preferably it is suggested that the axles of the synchronization wheels are oriented in the direction of the surface normal of a support of the center rail that takes the load of a drawer attachable to the drawer extraction guide. Thereby, the synchronization wheels are oriented parallel or at least almost parallel and therefore in a space-saving manner in respect to the support of the center rail. With this orientation, it is possible to arrange the synchronization wheels between the center rail and the drawer rail and therefore in the area of the outer carriage or between the center rail and the corpus rail and therefore in the area of the inner carriage. This allows for a compact construction of the drawer extraction guide.

A compact design of the drawer extraction guide may furthermore be achieved with a transfer member comprising along its longitudinal extension at least a first and a second toothed rack with teeth pointing in the same direction, and with a synchronization wheel of one of the wheel sets meshing with the first toothed rack and with a synchronization wheel of the further wheel set meshing with the second toothed rack. Thereby, the wheel sets can be arranged on the same side of the transfer element and the axles of their synchronization wheels can have the same orientation. Thereby, one wheel set can be arranged above and one wheel set below the support of the center rail and supported by the center rail in a space-saving manner. Thus, the synchronization wheels of the wheel sets are arranged in planes that are offset in respect to each other, whereby in each of the planes, one of the toothed racks of the transfer member is guided.

To simplify the assembly of the drawer extraction guide, the first and/or the second toothed rack of the transfer member may comprise one or more recesses into which an insert may be placed in such a way that a toothed rack section of the insert closes the gap formed by the recess in the respective toothed rack. During the assembly, the insert is not inserted into the recess. The transfer member is oriented in respect to the wheel sets so that the synchronization wheel formed as a gearwheel, which in operation meshes with the toothed rack, is arranged in the area of the recess of the toothed rack. Then, the synchronization wheel and the corresponding wheel set are not coupled with the transfer member, which means that a rotational movement of the wheel set is not transferred to the transfer member. In this assembly stage, the synchronization device is therefore not active and the rails and the carriages of the drawer extraction guide can be slid inside each other independently from each other. If the rails and the carriages are positioned correctly in respect to each other, the inserts can be inserted into the respective recesses. Together with their toothed rack sections, they form an extension of the toothing of the respective toothed rack, into which recess they are inserted, into which the synchronization wheel meshing with the toothed rack engages.

In a particularly preferred embodiment, the transfer member is supported in the extraction direction of the drawer extraction guide in a sliding manner by the center rail and/or the drawer rail and/or the corpus rail. A movement of the transfer member obliquely to the extraction direction is blocked. A transfer member supported in a sliding manner can be manufactured in an easy and cost-effective manner because no movable parts such as rollers, balls, or cylinders have to be provided at the transfer member. Since the transfer member does not transfer any loads of a mounted drawer, the slide bearing allows for a sufficiently smooth-running movement of the transfer member. The support on the corpus rail, the center rail, or the drawer rail is advantageous because they have suitable surfaces extending in the extraction direction of the drawer extraction guide along which the transfer member can be moved. In a particularly preferred embodiment, the transfer member is supported in a sliding manner on the center rail. Preferably, it then supports the synchronization wheels of the wheel sets. The rolling surfaces of the transfer member, and in particular the toothed racks intended for this purpose, can, in such a configuration, be easily brought into contact with the respective synchronization wheels of the wheel sets rolling on the transfer member.

A compact configuration of the drawer extraction guide with a high transferable load can be achieved by arranging the transfer member between two outer carriages which act between the drawer rail and the center rail. The carriages therefore are distanced from each other at least according to the length of the transfer member. Thus, the drawer is supported in two areas that are spaced comparatively far apart from each other, which results in a good load distribution. Preferably, the same outer carriages can be used for drawer extraction guides having different lengths and/or which can be extracted differently far, and only the length of the transfer member must be adapted to the modified travel range. Thereby, the manufacturing costs for drawer extraction guides of different lengths may be kept low.

In order to limit the travel range of the drawer extension guide, it may be possible for the movement range of the transfer member to be limited by stops, and preferably that the movement range of the transfer member is limited in the extraction direction of the drawer extraction guide by the sixth stop arranged at the front end of the center rail and opposite to the extraction direction by the 12th stop arranged at the rear end of the drawer rail. If the transfer member abuts against one of the stops, it cannot be moved any further in this direction. Accordingly, the rotational movements of the wheel sets coupled with the transfer member and therefore the linear movements of the rails and carriages coupled with the wheel sets are blocked as well.

Hereinafter, the invention is described in further detail with reference to the exemplary embodiments illustrated in the drawings.

Figure 2:
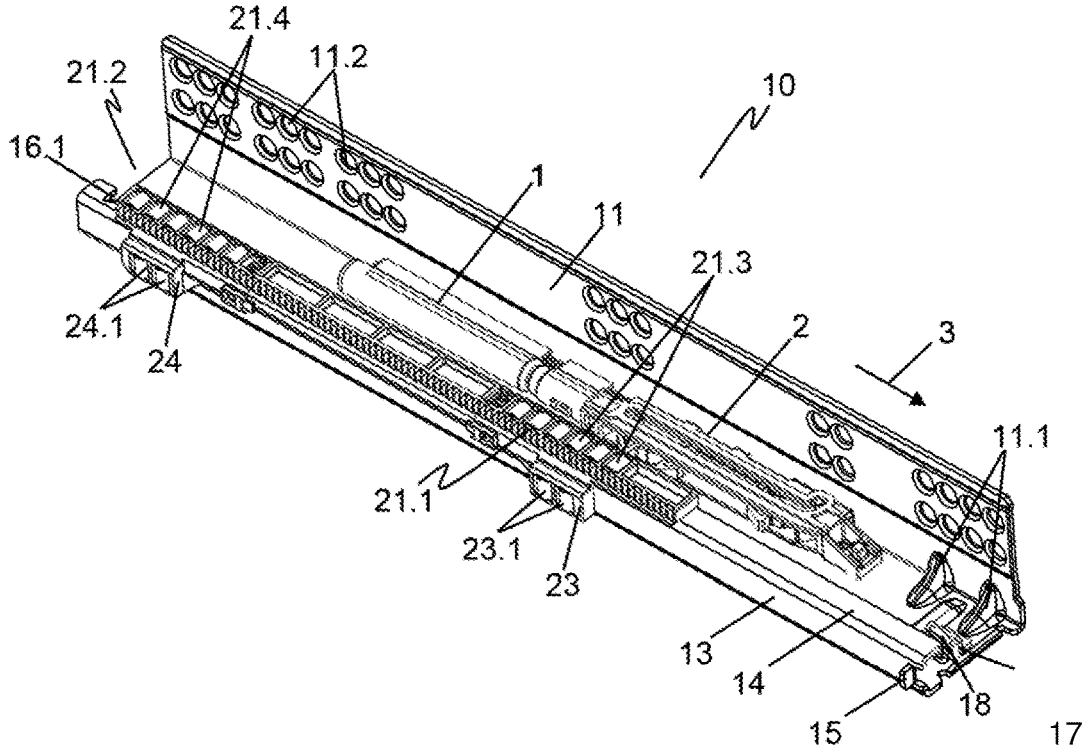
Figure 3:
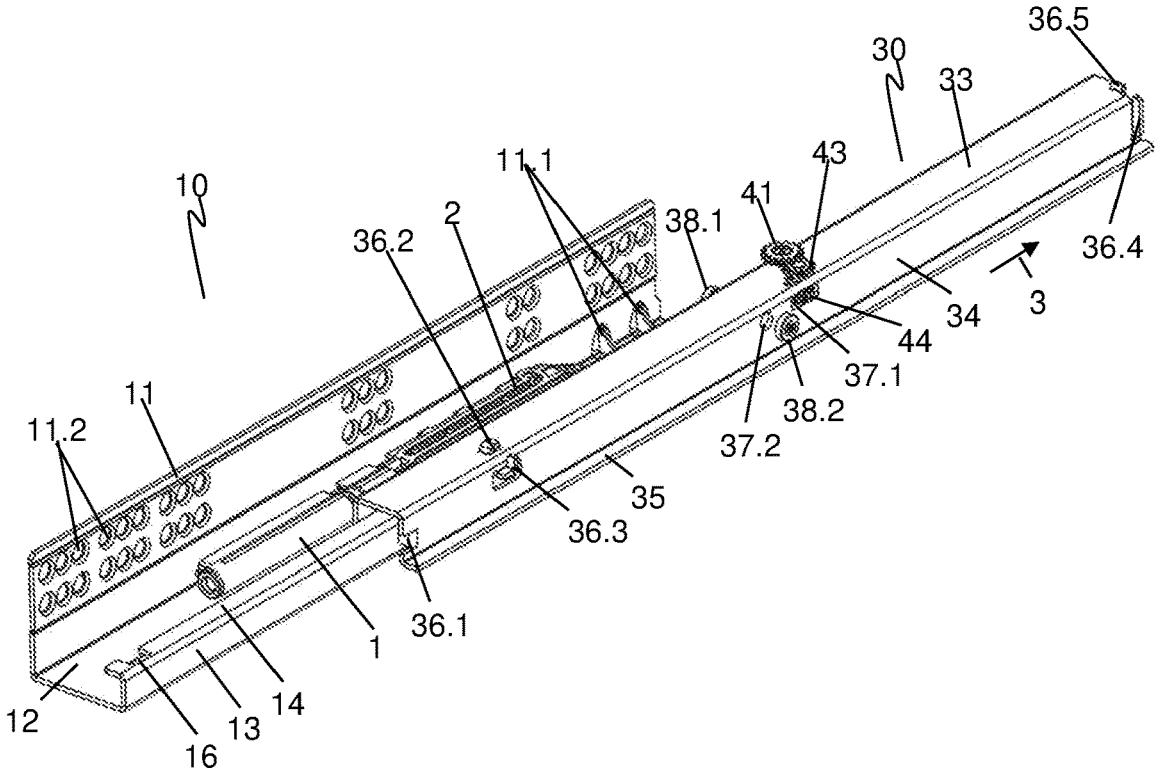
Figure 4:
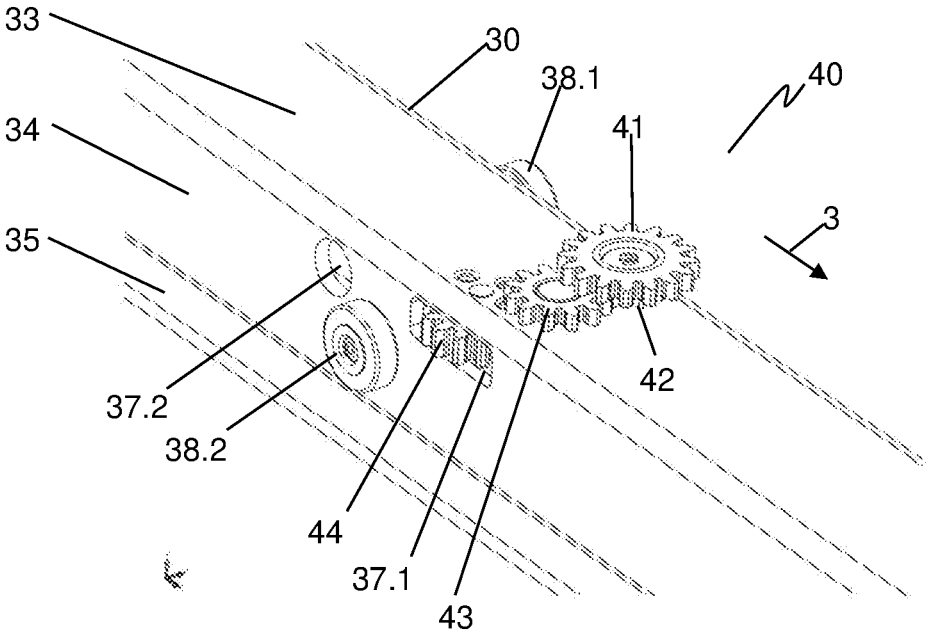
Figure 5:
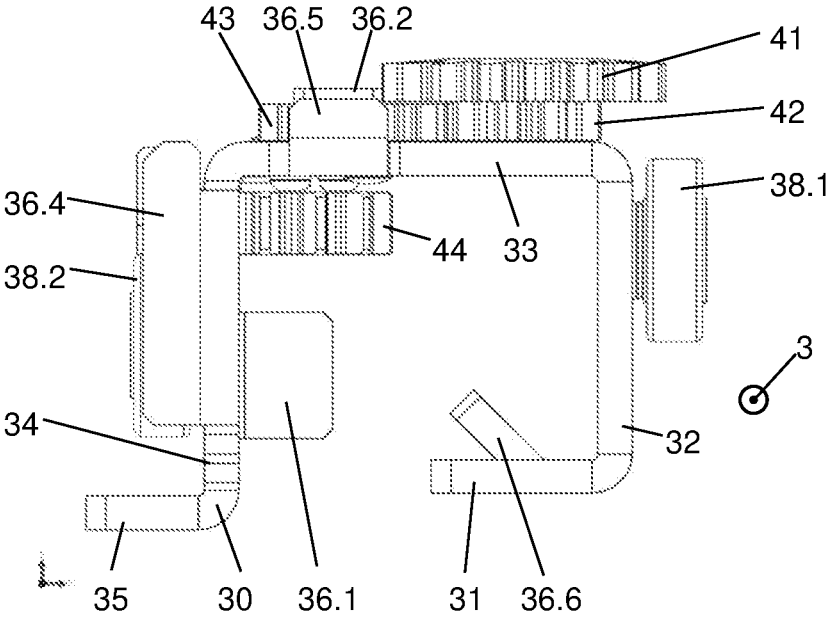
Figure 6:
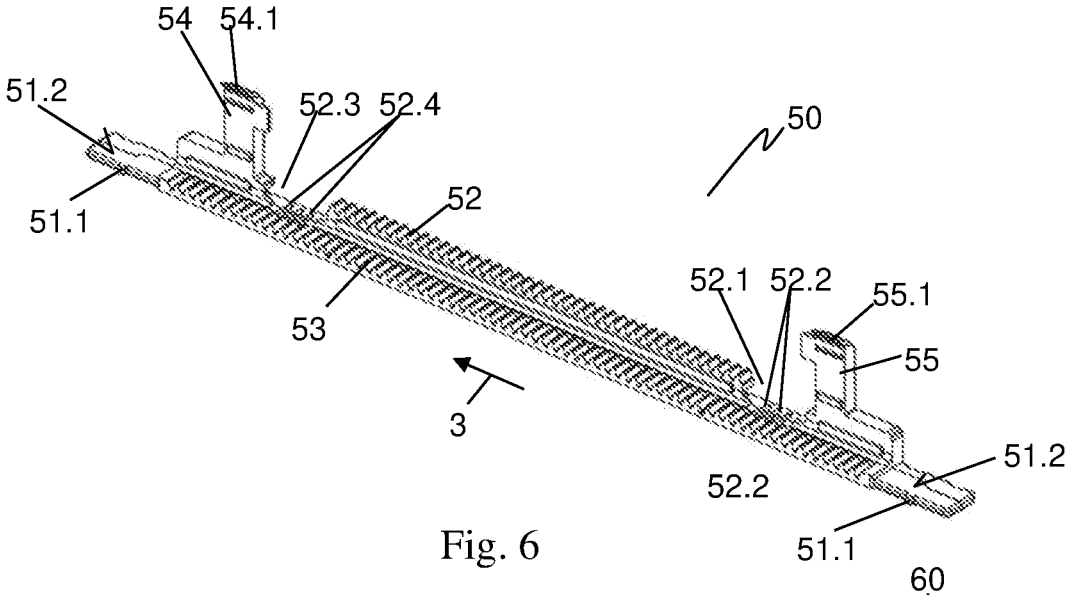
Figure 7:
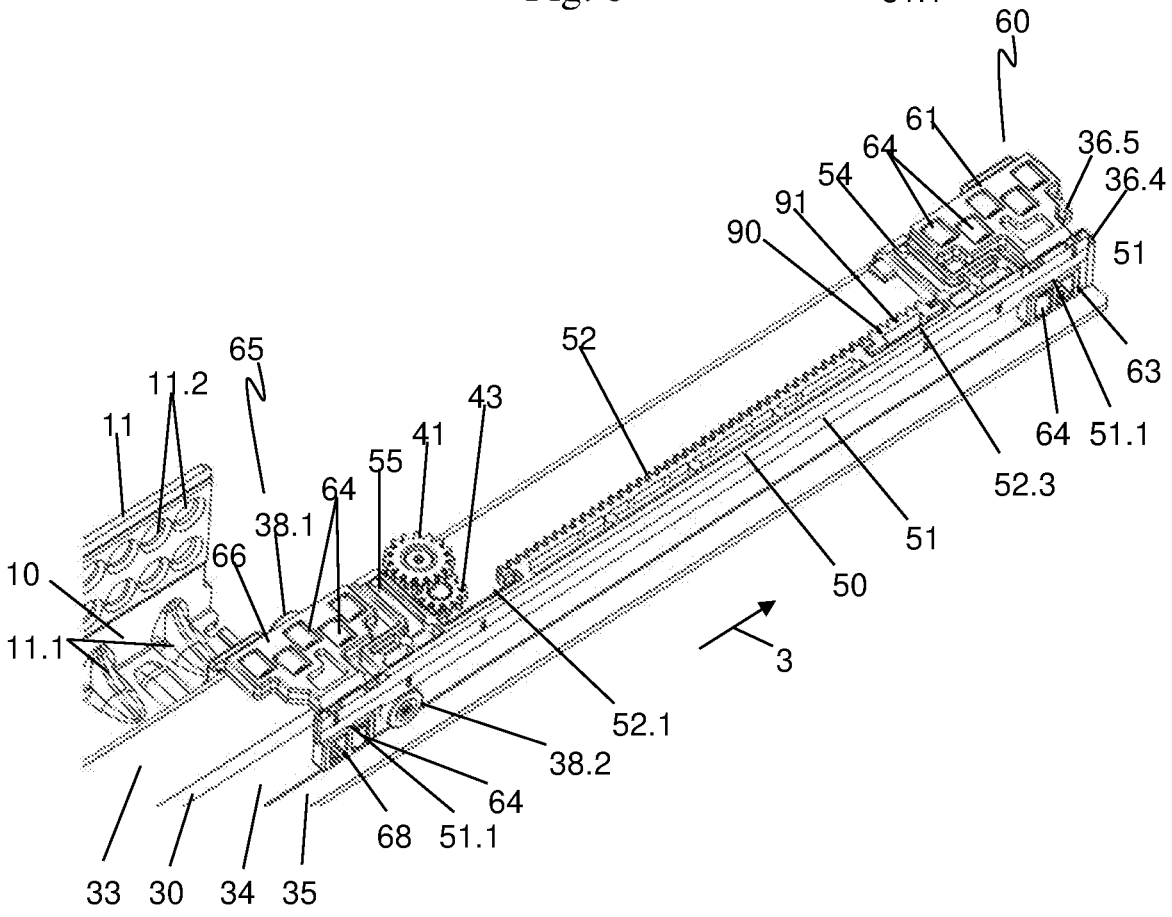
Figure 8:
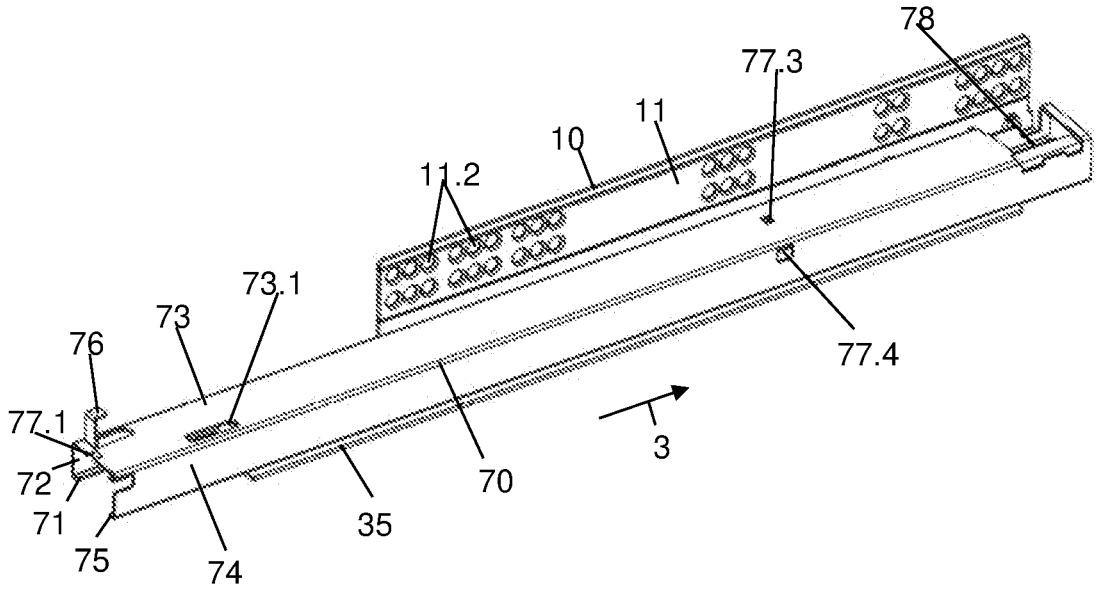
Figure 9:
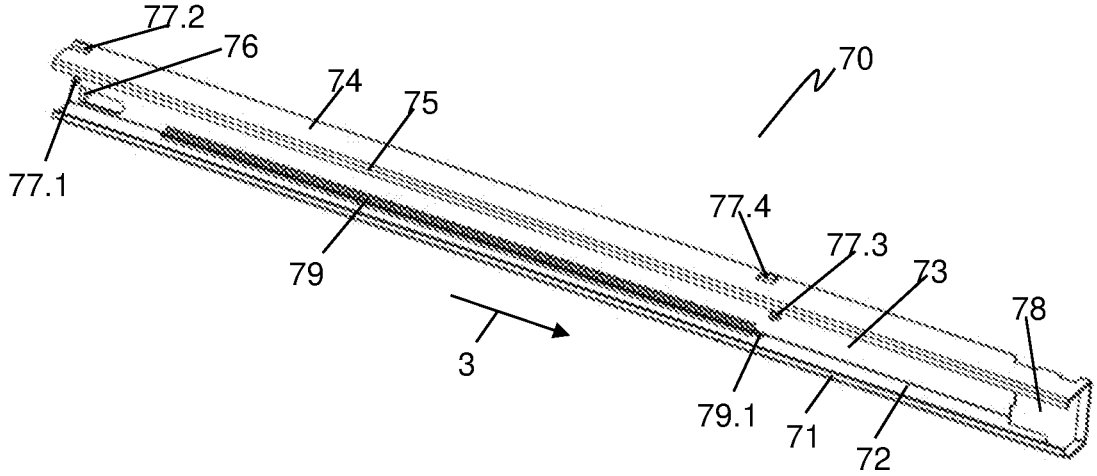
Figure 10:
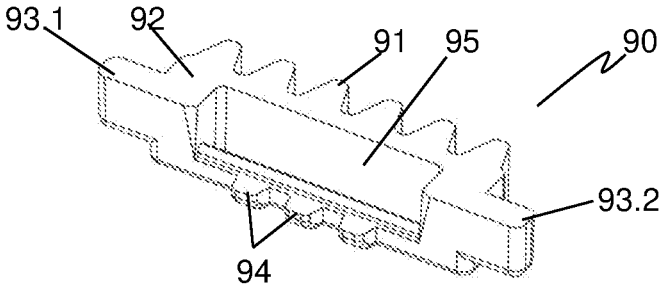
Figure 11:
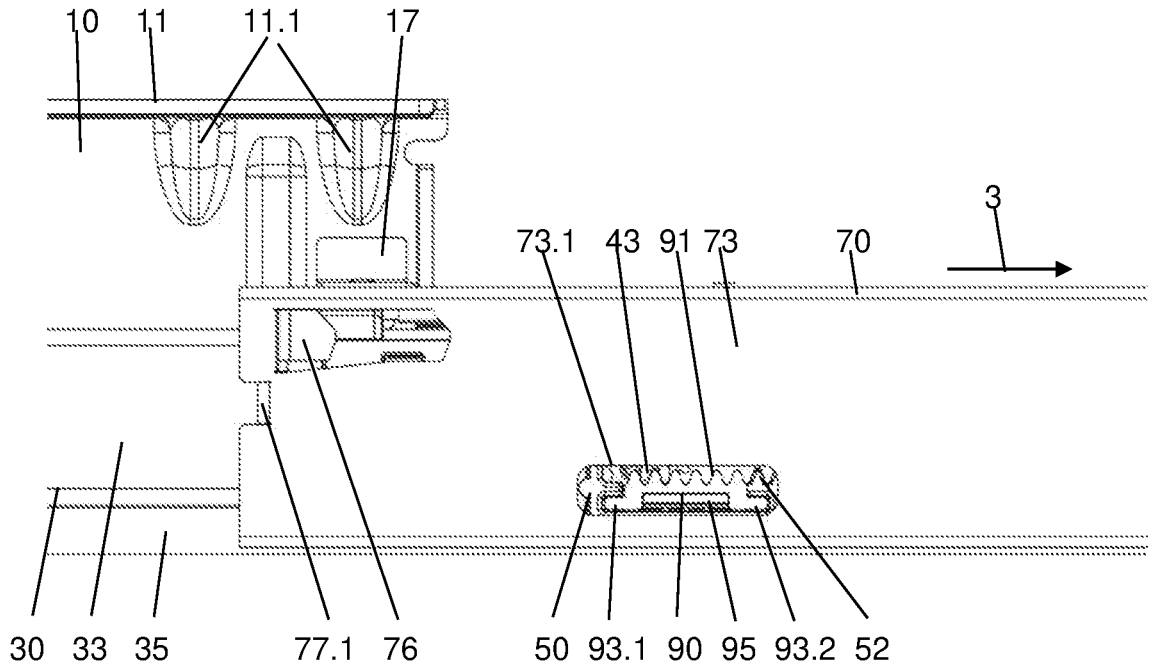
Figure 12:
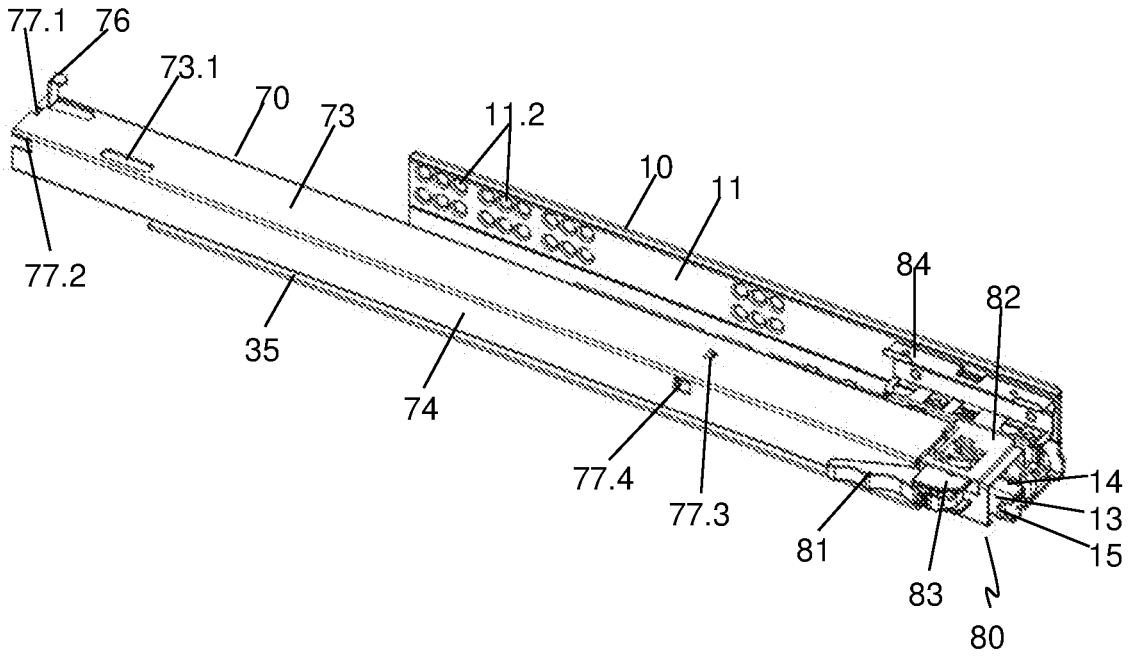
Figure 13:
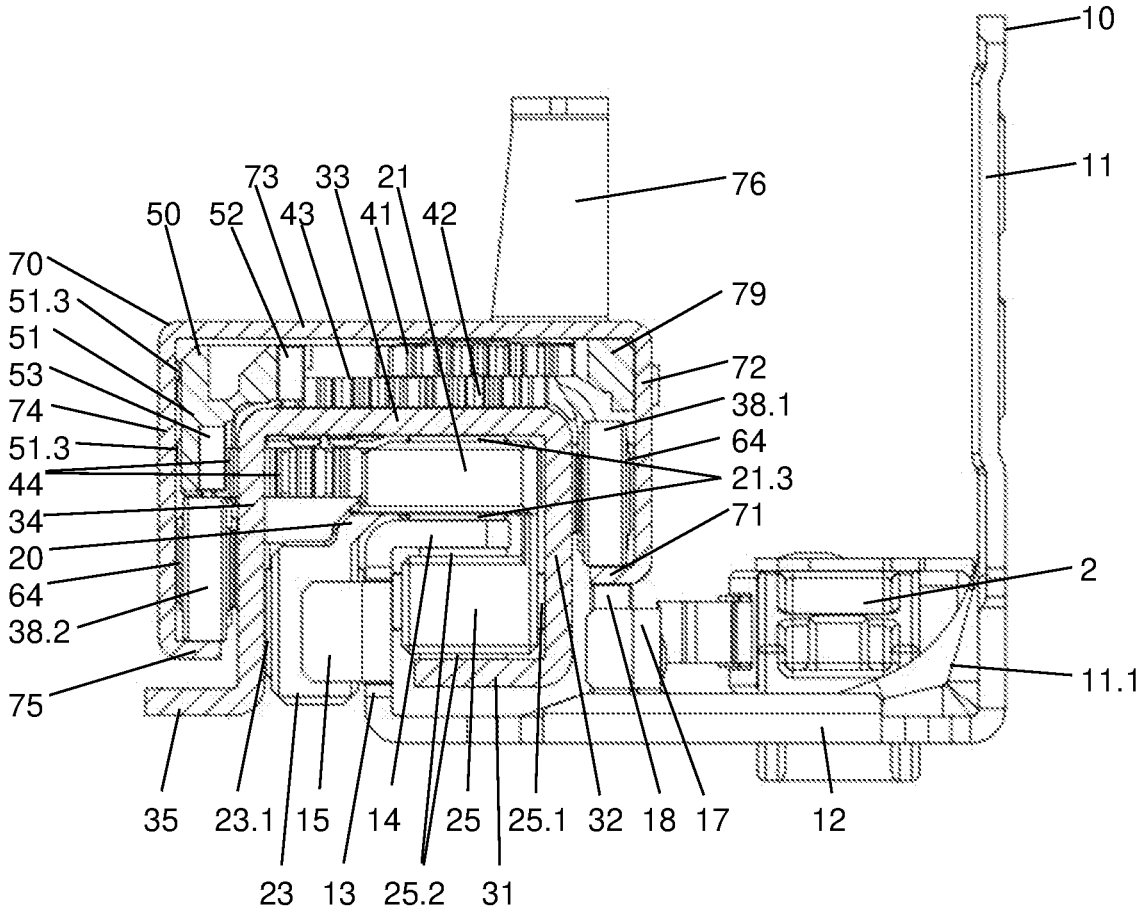
Figure 14:
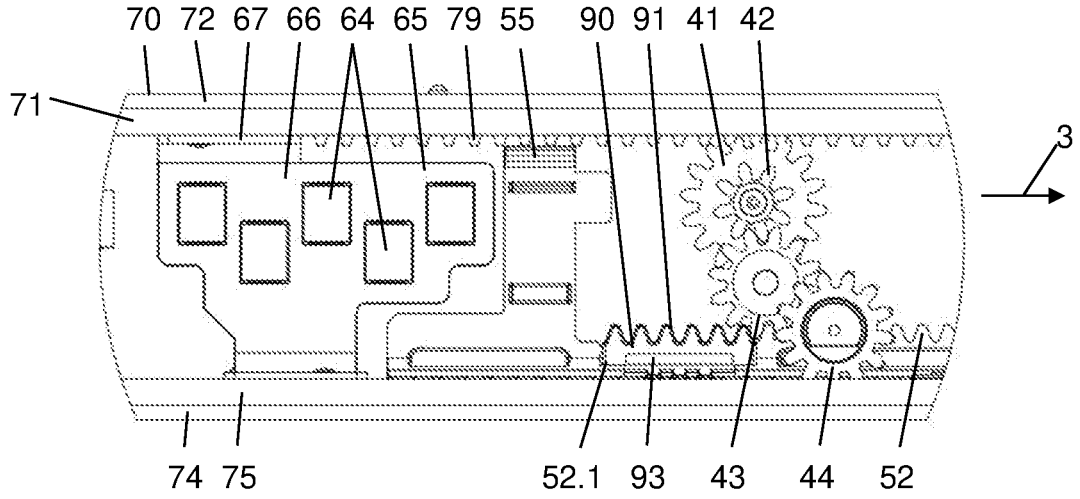
Figure 15:
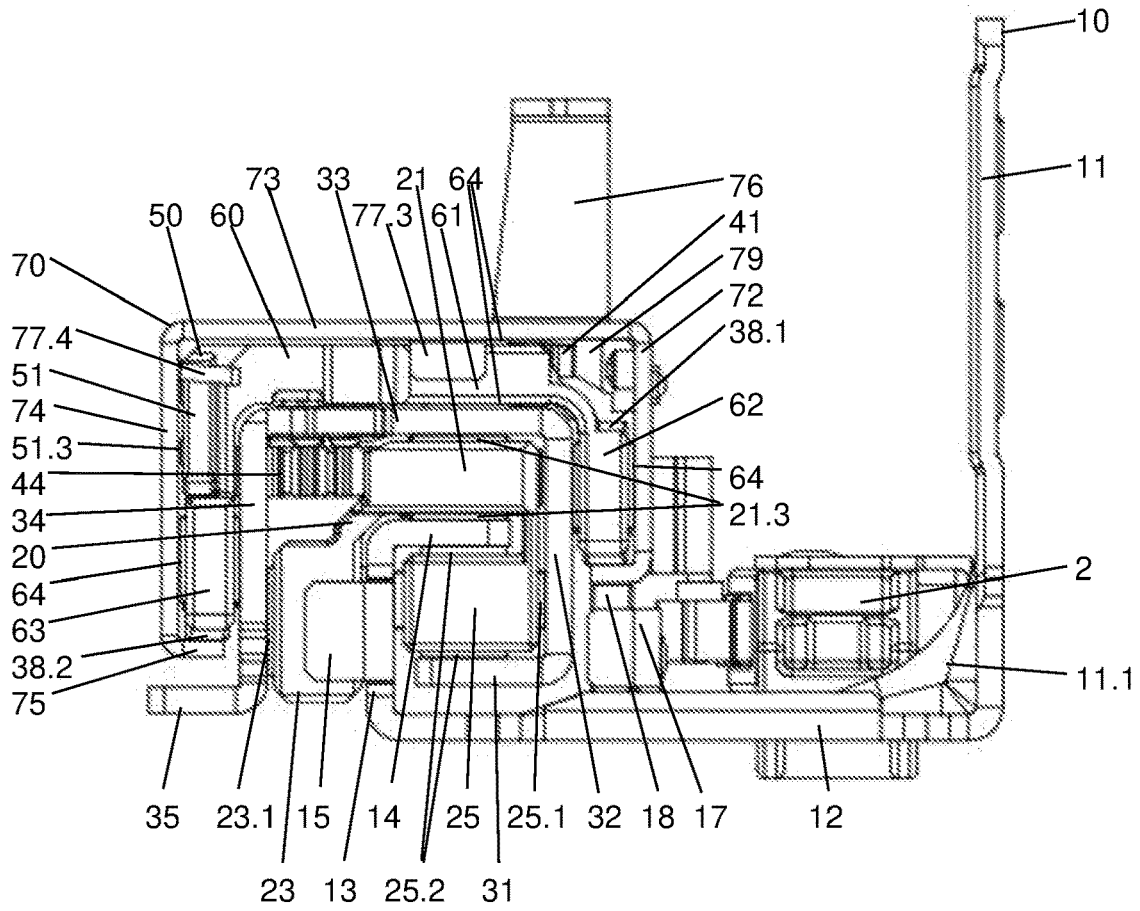
Figure 16:
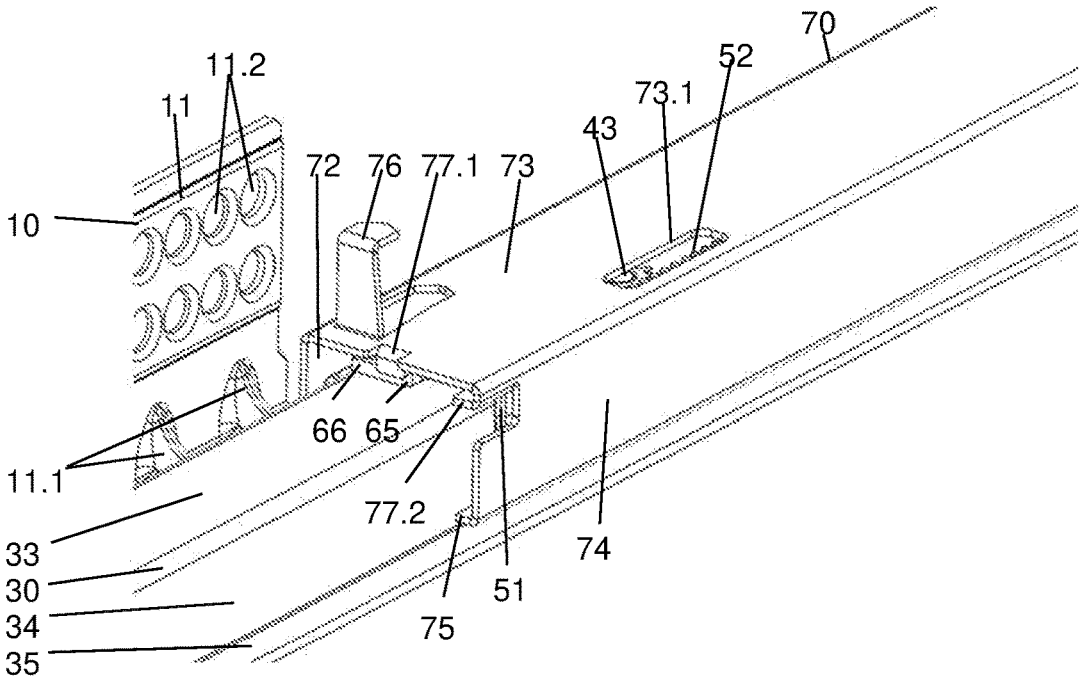
Figure 17:
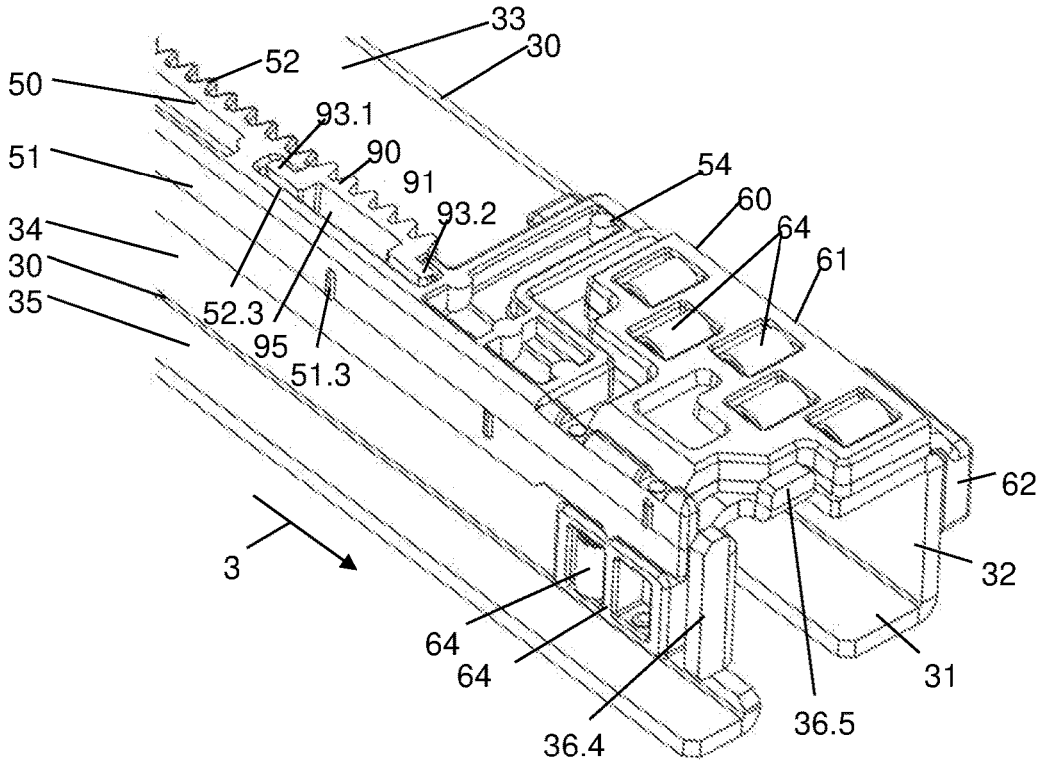
Figure 18:
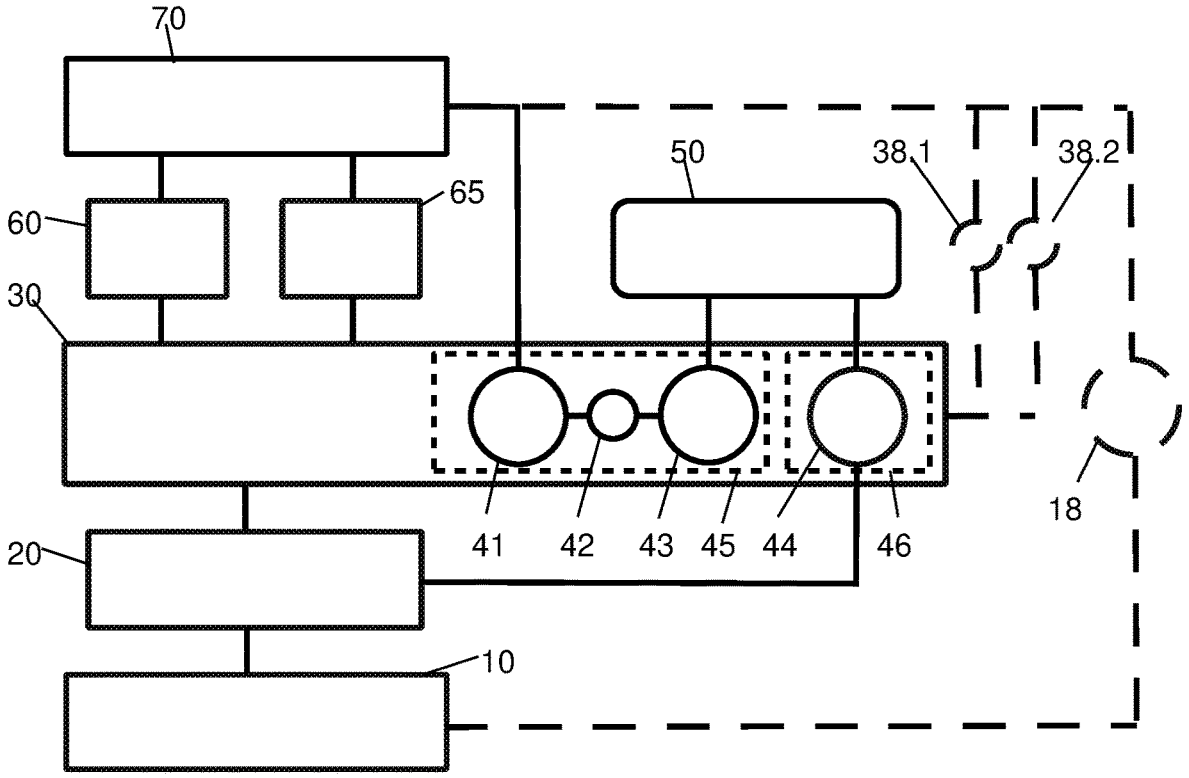

FIG. 1 shows a drawer extraction guide for guiding a drawer in a linear manner in an exploded view, FIG. 2 shows a part of the drawer extraction guide of FIG. 1 after a first assembly step in a perspective view, FIG. 3 shows a part of the drawer extraction guide of FIG. 1 after a further assembly step in a perspective view, FIG. 4 shows a section of a center rail in a perspective view with components of a synchronization device, FIG. 5 shows the center rail of FIG. 4 in a viewing direction along the longitudinal extension of the drawer extraction guide with components of the synchronization device of FIG. 4, FIG. 6 shows a transfer member in a perspective view, FIG. 7 shows the drawer extraction guide of FIG. 1 in a perspective view after a further assembly step with a transfer member arranged at the center rail and outer carriage, FIG. 8 shows the partially mounted drawer extraction guide in a perspective view with a drawer rail arranged thereon, FIG. 9 shows the drawer rail of FIG. 8 in a perspective bottom view, FIG. 10 shows an insert in a perspective view, FIG. 11 shows a section of the partially assembled drawer extraction guide in a top view with a mounting opening in the center rail for mounting the insert of FIG. 10, FIG. 12 shows the drawer extraction guide in a perspective view with a coupling arranged thereon, FIG. 13 shows the drawer extraction guide of FIG. 12 in a viewing direction along its longitudinal extension and in a sectional view, FIG. 14 shows a section of the drawer extraction guide of FIG. 12 in a bottom view with components of the synchronization device of FIG. 4, FIG. 15 shows the drawer extraction guide of FIG. 12 in a viewing direction along its longitudinal extension, FIG. 16 shows the drawer extraction guide of FIG. 12 in a perspective view with stops arranged at the center rail, FIG. 17 shows the front end of the center rail in a perspective view, and FIG. 18 shows a block diagram of the components of the drawer extraction guide and their cause-effect relationships.

FIG. 1 shows an exploded view of a drawer extraction guide for guiding a drawer in a linear manner. The drawer is not shown.

The components of the drawer extraction guide shown in FIG. 1 are shown from slightly different points of view. Different scales may have been used for the components and assemblies shown in FIG. 1 and the other figures within a figure as well as between the figures.

A corpus rail 10, an inner carriage 20, a center rail 30, a transfer member 50, a front and a rear outer carriage 60, 65 as well as a drawer rail 70 with a coupling 80 to be mounted thereto are assigned to the drawer extraction guide. The drawer extraction guide also comprises a synchronization device 40, to which gearwheels 41, 42, 43, 44 arranged on the center rail 30 and shown in further detail in FIG. 4 or FIG. 5, respectively, as well as the transfer member 50 are assigned. An insert 90 is assigned to the transfer member 50. The corpus rail 10 may also be referred to as the body rail 10.

Hereinafter, the spatial information refers to the typical installation situation of the drawer extraction guide at a piece of furniture. Thereby, the drawer extraction guide is oriented along its longitudinal extension obliquely, preferably perpendicular in respect to the direction of the acting gravitational force. Front areas of the drawer extraction guide and of components of the drawer extraction guide, respectively, are arranged at the front with regard to an extraction direction 3 of a drawer guided by the drawer extraction guide, and rear areas are arranged in the back with regard to the extraction direction 3. Within customary tolerances, the extraction direction 3 lies on a horizontal plane, the surface normal of which defines a vertical orientation.

The shown drawer extraction guide of the exemplary embodiment is arranged in its assembled position on the left side of a piece of furniture, with regard to the extraction direction 3 of the drawer. The piece of furniture is not shown. A correspondingly mirror-inverted drawer extraction guide can be provided on the opposite side of the drawer. Thereby, individual components of the drawer extraction guide, for example a subsequently mentioned damping member 1 or a retraction member 2, may be provided only at one of the drawer extraction guides provided on opposite sides.

In a different installation situation of the drawer extraction guide, this information must be applied accordingly. This does not change the basic function of the drawer extraction guide.

The corpus rail 10 is realized as a metal profile. A base 12 is attached to a retaining section 11, which is preferably oriented vertically in the assembled position, at an angle. The base 12 extends away from the retaining section 11. When the drawer extraction guide is mounted, the base 12 preferably has a horizontal orientation. Opposite to the retaining section 11 a lateral guide section 13 is formed in an angle at the base 12. The lateral guide section 13 extends, starting from the base 12, at a distance from the retaining section 11 in the same direction as the retaining section 11. It transitions into a support section 14. The support section 14 is oriented towards the retaining section 11. It is therefore oriented corresponding to the base 12 and arranged at a distance from it. Mounting holes 11.2 are provided in the retaining section 11. Through these fastening members, which are not shown, can be passed and the corpus rail 11 can be attached to a corpus of a piece of furniture, which is not shown. Reinforcing braces 11.1 are formed in the corpus rail 10 at the transition from the retaining section 11 to the base 12. They reinforce the transition from the retaining section 11 to the base 12 so that the angle between the retaining section 11 and the base 12 is maintained even under heavy load applied to the corpus rail 10, and in order to safely transmit pressure applied by a mounted drawer to the furniture corpus.

The damping member 1 and the retraction member 2 are attached to the base 12 of the corpus rail 10. The damping member 1 dampens the movement of a drawer guided by the drawer extraction guide towards the end of the closing process. The retraction member 2 causes a self-acting closure of the drawer in its last movement section during the sliding in. A first stop 15 is formed at the lateral guide section 13 in the front area of the corpus rail 10. The first stop 15 is formed from the end of the lateral guide section 13, preferably punched out, and arranged in such an angle that it protrudes from the outer surface of the lateral guide section 13 in the form of a lug. A second stop 16 is provided opposite and therefore in a rear area of the corpus rail 10. The second stop 16 is cut out of the support section 14 of the corpus rail 10, preferably punched out, and arranged in an angle towards the base 12 of the corpus rail 10. In the front area of the drawer extraction guide a roller 18 is fastened to the base 12 of the corpus rail 10 by means of a reel seat 17. The rolling direction of the roller 18 runs in the extraction direction 3 of the drawer extraction guide. The roller 18 is arranged above the base 12.

The inner carriage 20 has a longitudinal extension in the extraction direction 3 of the drawer extraction guide. The term "inner" refers to the arrangement of the inner carriage 20 together with the other components of the drawer extraction guide and therefore particularly in relation to the arrangement of the outer carriages 60, 65. At the end of a base part 21 of the inner carriage 20, roller sections 21.1, 21.2 with retainers for first and second roller members 21.3, 21.4 are provided. The axles of the first and second roller members 21.3, 21.4 are oriented in such a way that, when the drawer extraction guide has been mounted, the roller members 21.3, 21.4 roll on the support section 14 of the corpus rail 10. Their rolling direction is directed towards the extraction direction 3 of the drawer extraction guide. A third toothed rack 22 is arranged at the base part 21 of the inner carriage 20. In the present case, the third toothed rack 22 is designed as a single part with the base part 21. It is arranged with its toothing pointing away from the retaining section 11 of the corpus rail 10 and therefore away from a wall of the furniture corpus to which the drawer extraction guide is attached. The third toothed rack 22 preferably extends along the entire length of the inner carriage 20. On the side of the third toothed rack 22, a front inner roller slide 23 and a rear inner roller slide 24 are connected to the base part 21 in an angle and preferably as a single part. The inner roller slides 23, 24 are, starting from the base part 21, oriented towards the base 12 of the corpus rail 10. They comprise retainers for third and fourth roller members 23.1, 24.1. In the assembly state shown, only one third or fourth roller member 23.1, 24.1, respectively, is mounted in a corresponding retainer of the respective inner roller slide, and a further retainer is free. In these free retainers, a further third or fourth roller member 23.1, 24.1, respectively, can be inserted in a rotatably supported manner. The axles of the third and fourth roller members 23.1, 24.1 are oriented in such a way that the third and fourth roller members 23.1, 24.1 roll on the lateral guide section 13 of the corpus rail 10. The rolling direction of the third and fourth roller members 23.1, 24.1 is directed along the extraction direction 3 of the drawer extraction guide. Opposite to the front inner roller slide 23, a front outer roller slide 25, and opposite the rear inner roller slide 24, a rear outer roller slide, which is not visible in the shown perspective, are connected to the base part 21. With regard to the base part 21, the outer roller slides 25 are oriented towards the base 12. At least a fifth and at least a sixth roller member 25.1, 25.2 are arranged in the outer roller slides 25, as shown in FIG. 13. The axles of the fifth and sixth roller members 25.1, 25.2 are oriented obliquely, preferably perpendicular in respect to each other. In the mounted drawer extraction guide, the axles of the fifth roller members 25.1 are oriented preferably vertically and the axles of the sixth roller members 25.2 preferably horizontally. The rolling direction of the fifth and the sixth roller members 25.1, 25.2 runs in the extraction direction 3 of the drawer extraction guide. The front roller slides 23, 25 and the rear roller slides 24, 26 are each separated from each other by a slot. In the mounted drawer extraction guide, the lateral guide section 13 of the corpus rail 10 is arranged in this slot. Except for the roller members 21.3, 21.4, 24.1, 25.1, 25.2 and their axles, the inner carriage 20 is preferably made from a plastic, particularly preferable in a plastic injection molding process.

The center rail 30 is realized as a profile member, preferably of metal. Along its longitudinal extension, it has a support 33, at each of its opposing longitudinal sides a lateral guide 32, 34 is arranged in an angle. The support 33 is oriented corresponding to the base 12, and the lateral guides 32, 34 are oriented corresponding to the lateral guide section 13 of the corpus rail 10. Thereby, the lateral guides 32, 34 are directed, starting from the support 33, towards the base 12 of the corpus rail 10. A height guiding member 31 is formed at the outer lateral guide 32 opposite to the support 33. The height guiding member 31 is oriented corresponding to the support 33 and is directed towards the inner lateral guide 34. An angled element 35 is provided at the bottom end of the inner lateral guide 34. It is also oriented corresponding to the support 33 and is directed away from the inner lateral guide 34. A third stop 36.1 is arranged at the rear end face of the inner lateral guide 34. As shown in further detail in FIG. 3, the third stop 36.1 can be realized as a lug cut out of the inner lateral guide 34 and bent towards the outer lateral guide 32. A fifth stop 36.3 may be formed at the inner lateral guide 34, viewed in the extraction direction 3 spaced apart from the third stop 36.1, as a cut-out and sideways-bent lug. The fifth stop 36.3 is bent away from the outer lateral guide 32. It therefore protrudes from the inner lateral guide 34 in the same direction as the angled element 35. A sixth stop 36.4 is arranged in an angle at the front end of the inner lateral guide 34. It may also be realized in the form of a lug pointing away from the outer lateral guide 32. A fourth stop 36.2 protrudes from the support 33 in the area of the fifth stop 36.3. The fourth stop 36.2 is represented by a lug, which is preferably punched out from the support 33 and bent upwards. At the front end face of the support 33, a lug is also cut out of the support 33 and bent upwards. This lug forms a seventh stop 36.5 at the support 33 in the area of the fifth stop 36.4 at the inner lateral guide 34. In a middle region of the center rail 30, an outer track roller 38.1 is rotatably supported at the outer lateral guide 32 and an inner track roller 38.2 is rotably supported at the inner lateral guide 34. The axes of rotation of the outer and the inner track rollers 38.1, 38.2 are each oriented towards the opposite lateral guide 32, 34 and therefore obliquely in respect to the extraction direction 3 of the drawer extraction guide. The direction of travel of the track rollers 38.1, 38.2 is directed in the extraction direction 3. Components of the synchronization device 40 are arranged in the middle region of the center rail 30, as can be seen in detail in FIGS. 4 and 5.

The transfer member 50 comprises a lateral sliding rail 51. Facing away from the retaining section 11 of the corpus rail 10 and therefore from a wall of a furniture corpus, to which the drawer extraction guide is to be attached, the sliding rail 51 forms a surface from which nubs 51.3 arise. Two toothed racks 52, 53 are formed at the transfer member 50 opposite to the surface, as can be seen in FIG. 6. The toothed racks 52, 53 are arranged above one another. The second toothed rack 52, which is arranged on top when the drawer extraction guide has been mounted, is shorter than the third toothed rack 53 below it. It protrudes the third toothed rack 53 pointing away from the sliding rail 51. As can be seen in FIG. 1, a rear and a front recess 52.1, 52.3 are formed into the transfer member 50 at the opposite ends of the second toothed rack 52. The recesses 52.1, 52.3 are formed such that one of the inserts 90 each can be inserted and fixed therein, as it is shown for the front recess 52.3. A toothed rack section 91 with the same toothing as the second toothed rack 52 is formed at a base body 92 of the insert 90, as shown in particular in FIG. 10. Connecting pins 93.1, 93.2 are arranged at the ends of the insert 90. A latching member 94 is formed at the base body 92. A depression 95 is formed in the base body 92 opposite the toothed rack section 91. In an insert 90 inserted into a recess 52.1, 52.3, the toothed rack section 91 forms an extension of the first toothed rack 52 of the transfer member 50.

A front sliding member 54 is formed at the lateral sliding rail 51 subsequent to the front recess 52.3 in the second toothed rack 52. On the opposite side subsequent to the rear recess 52.1, a rear sliding member 55 is connected in a single part with the lateral sliding rail 51. The sliding members 54, 55 are oriented corresponding to the support 33 of the center rail 30. At their ends, they transition into angled lateral bent elements 54.1, 55.1, as can be clearly seen in FIG. 6. FIG. 6 also shows that the third toothed rack 53 is guided up to the area below the sliding members 54, 55. On the sides of the sliding members 54, 55, the lateral sliding rail 51 forms lateral sliding surfaces 51.2. The lateral sliding surfaces 51.2 point in the same direction as the toothed racks 52, 53. In the area of the lateral sliding surfaces 51.2, spacers 51.1 in the form of protrusions are formed at the bottom edge of the lateral sliding rail 51.

The transfer member 50 or the insert 90, respectively, can be manufactured in a cost-efficient manner from plastic material, preferably in an injection molding process.

The outer carriages 60, 65 each comprise a carriage base body 61, 66, an outer roller support 62, 67 (refer to FIG. 14), and an inner roller support 63, 68. Rollers 64 are supported at the carriage base bodies 61, 66 and the roller supports 62, 63, 67, 68. The carriage base bodies 61, 66 have a flat shape. Along their longitudinal extension directed in the extraction direction 3 of the drawer extraction guide, the carriage base bodies 61, 66 are penetrated by openings in which the rollers 64 are arranged. On both sides, the rollers 64 protrude beyond the external surfaces of the carriage base bodies 61, 66. When the drawer extraction guide is mounted, the carriage base bodies 61, 66 and the axles of the rollers 64 positioned therein are oriented corresponding to the support 33 of the center rail 30. The inner roller supports 63, 68 are formed at the carriage base bodies 61, 66 in an angle. They are arranged at the side of the carriage base bodies 61, 66 facing away from the retaining section 11 of the corpus rail 10. The inner roller supports 63, 68 are directed, starting from the carriage base bodies 61, 66, towards the base 12 of the corpus rail 10. Opposite of the inner roller supports 63, 68, the outer roller supports 62, 67 are connected to the carriage base bodies 61, 66. In the selected perspective of FIG. 1, only part of the front outer roller support 62 of the outer roller supports 62, 67 is visible. The outer roller supports 62, 67 are also arranged at an angle in respect to the carriage base bodies 61, 66 and are directed towards the base 12 of the corpus rail 10. The roller supports 62, 63, 67, 68 are penetrated by openings. The rollers 64 are positioned in the openings such that they protrude beyond the opposite surfaces of the roller supports 62, 63, 67, 68 obliquely in respect to the extraction direction 3, as it is shown in particular in FIG. 13. The axles of the rollers 64 supported in the roller supports 62, 63, 67, 68 are oriented obliquely in respect to the extraction direction 3 and towards the base 12 of the corpus rail 10. The rolling direction of the rollers 64 corresponds to the extraction direction 3 of the drawer extraction guide or, respectively, of a drawer supported by the drawer extraction guide. The outer carriages 60, 65 are preferably made at least partially from a plastic, and particularly preferable in an injection molding process.

The drawer rail 70 is realized as a profile member elongated in the extraction direction 3 of the drawer extraction guide, preferably of metal. It comprises a cover 73 on the opposite longitudinal sides of which an an external surface 72 and an internal surface 74 are attached in an angle. The cover 73 is oriented corresponding to the support 33 and the external and internal surface 72, 74 corresponding to the outer and inner lateral guide 32, 34 of the center rail 30. In a drawer extraction guide installed at a piece of furniture, the cover 73 preferably has a horizontal orientation and the external and internal surface 72, 74 preferably have a vertical orientation directed downwards. Thereby, the external surface 72 faces the retaining section 11 of the corpus rail 10 and therefore a wall of the piece of furniture to which the drawer extraction guide is attached. Opposite the cover 73, the longitudinal sides of the external and internal surface 72, 74 are arranged in an angle. As can be seen in particular in FIG. 9, an outer running surface 71 is arranged at the external surface 72 and an inner running surface 75 at the internal surface 74. The running surfaces 71, 75 are oriented facing towards each other.

As shown in FIG. 1, a ninth and tenth stop 77.1, 77.2 as well as a drawer stop 76 are formed at the rear end of the drawer rail 70. The stops 77.1, 77.2, 76 may be cut out of the drawer rail 70 in the form of lugs and bent in such a way that they have the desired orientation. The ninth stop 77.1 is formed at the end of the cover 73 of the drawer rail 70 and, starting from the cover 73, is bent towards the base 12 of the corpus rail 10. The tenth stop 77.2 is formed at the end of the internal surface 74 of the drawer rail 70 and bent towards its internal surface 74. The drawer stop 76 is bent out of the plane of the cover 73 pointing away from the base 12 of corpus rail 10. Its end facing away from the cover 73 has a tapered shape, and is directed by means of a second bend in the extraction direction 3 of the drawer extraction guide. A rear section of the cover 73 is penetrated by a mounting opening 73.1. The mounting opening 73.1 is an elongated hole that extends along its longitudinal direction in the direction of the longitudinal extension of the drawer rail 70. An 11th stop 77.3 is arranged at the cover 73 spaced apart from the ninth stop 77.1. The 11th stop 77.3 is directed towards the base 12 of the corpus rail 10. A 12th stop 77.4 is formed spaced apart from the 10th stop 77.2 at the internal surface 74 of the drawer rail 70. The 12th stop 77.4 is directed towards the internal surface 74 of the drawer rail 70. A coupling receiver 78 is provided at the front end of the drawer rail 70 in the form of a recess provided in the cover 73. The coupling receiver 78 extends into the external surface 72 and the internal surface 74 of the drawer rail 70.

The coupling 80 faces the coupling receiver 78.

FIG. 2 shows a part of the drawer extraction guide after a first assembly step in a perspective view. During the first assembly step, the inner carriage 20 is connected with the corpus rail 10. To this end, the inner carriage 20 is slid onto the corpus rail 10. Then, the prepunched lugs of the first and the second stop 15, 16 are bent open so that the travel path of the inner carriage 20 is limited by the stops 15, 16. The first and second roller members 21.3, 21.4 of the inner carriage 20 rest on the support section 14 of the corpus rail 10. The base part 21 extends between the front and the rear roller section 21.1, 21.2. It is arranged above the support section 14. The front and the rear inner roller slides 23, 24 are each positioned laterally beside the lateral guide section 13 such that the roller members 23.1, 24.1 guided therein rest on the lateral guide section 13 and roll on them. As can be seen in FIG. 13, the outer roller slides 25, 26 encompass the support section 14 of the corpus rail 10, starting from the base part 21 with the front and the rear roller section 21.1, 21.2. The support section 14 is therefore arranged between the base part 21 with the front and the rear roller section 21.1, 21.2 and the respective outer roller slides 25, 26. The lateral guide section 13 of the corpus rail 10 is guided between the front inner roller slide 23 and the front outer roller slide 25 as well as between the rear inner roller slide 24 and the rear outer roller slide 26. Due to this arrangement of the roller slides 23, 24, 25, 26 opposite the third and fourth roller members 23.1, 24.1 of the inner roller slides 23, 24, the fifth roller members 25.1 supported in the outer roller slide 25, 26 rest on the lateral guide section 13 of the corpus rail 10 and roll on it. Opposite the first and second roller members 21.3, 21.4 that are supported in the front and rear roller section 21.1, 21.2, the sixth roller members 25.2 supported in the outer roller slides 25, 26 rest on the support section 14 of the corpus rail 10, on which they roll. The inner carriage 20 can therefore roll in the extraction direction 3 of the drawer extraction guide and is therefore supported in a smooth running manner at the corpus rail 10. The inner carriage 20 is blocked obliquely in respect to the extraction direction 3.

FIG. 3 shows a perspective view of a part of the drawer extraction guide shown in FIG. 1 after a further assembly step. In this assembly step, the center rail 30 is placed on the corpus rail 10 and the inner carriage 20 arranged thereon. Prior to the assembly step, the gearwheels 41, 42, 43, 44 as well as the track rollers 38.1, 38.2 are already rotatably connected with the center rail 30.

FIG. 4 shows a perspective view of a portion of the center rail 30 with components of the synchronization device 40. The gearwheels 41, 42, 43, 44 are rotatably supported at the support 33 of the center rail 30. The rotary axes of the gearwheels 41, 42, 43, 44 are oriented corresponding to the surface normal of the center rail 30. The first and second gearwheel 41, 42 are arranged on a common axle. Thereby, the first and second gearwheel 41, 42 are attached to each other in a torque proof manner. The first gearwheel 41 has a larger diameter than the second gearwheel 42. It is positioned above the second gearwheel 42, when the drawer extraction guide is mounted. The third gearwheel 43 is arranged in the plane of the second gearwheel 42 and meshes with it. The first, the second, and the third gearwheel 41, 42, 43 are arranged above the support 33. They form a first wheel set 45, as schematically shown in FIG. 18. The fourth gearwheel 44 is positioned below the support 33. It passes through an opening 37.1 that is provided in the inner lateral guide 34 of the center rail 30. The fourth gearwheel 44 represents, as also schematically shown in FIG. 18, a second wheel set 46. Opposite the outer track roller 38.1 supported at the outer lateral guide 32, an opening 37.2 is provided in the inner lateral guide 34. A corresponding opening 37.2, which is covered by the support 33 of the center rail 30, is provided opposite the inner track roller 38.2 in the outer lateral guide 32. For mounting the track rollers 38.1, 38.2, by means of the opening 37.2, a bearing position in the form of a bearing pin can be formed from the material of the inner or the outer lateral guide 32, 34. The track rollers 38.1, 38.2 can then be placed on these bearing positions. The track rollers 38.1, 38.2 are held at the inner or outer lateral guide 34, 32 and the external surface 72 or internal surface 74 of the drawer rail 70 in a manner undetachable in the direction of the axle.

FIG. 5 shows, in a viewing direction along the longitudinal extension of the drawer extraction guide, the center rail 30 shown in FIG. 4 with components of the synchronization device 40 shown in FIG. 4. It clearly shows the arrangement of the first, the second, and the third gearwheel 41, 42, 43 of the first wheel set 45 above and of the fourth gearwheel 44 of the second wheel set 46 below the support 33 of the center rail 30. The track rollers 38.1, 38.2 are connected to the center rail 30 at different heights. At the front end of the center rail 30, an eighth stop 36.6 is provided at the height guiding member 31. It is bent from the surface of the height guiding member 31 towards the support 33. The third stop 36.1 is guided in the area enclosed by the profile element of the center rail 30, while the sixth stop 36.4 is oriented outwards.

FIG. 6 shows a perspective view of the transfer member 50. The two toothed racks 52, 53 arranged next to each other can be seen clearly. Rear and front latching recesses 52.2, 52.4 are formed into the transfer member 50 in the area of the recesses 52.1, 52.3. These are formed correspondingly to the latching members 94 of the insert 90 shown in FIG. 10.

FIG. 7 shows the drawer extraction guide of FIG. 1 in a perspective view after a further assembly step with a transfer member 50 and outer carriages 60, 65 arranged at the center rail 30. The outer carriages 60, 65 are slid onto the center rail 30 from the back. They rest on the support 33 of the center rail 30 with the rollers 64 supported at the carriage base bodies 61, 66. The inner roller supports 63, 68 are arranged laterally in respect to the inner lateral guide 34 of the center rail 30 so that the rollers 64 supported at the inner roller supports 63, 68 rest and roll on the inner lateral guide 34. As shown in FIG. 13, the outer roller supports 62, 67 are supported around the center rail 30, opposite the inner roller supports 63, 68. They are arranged at such a distance to the outer lateral guide 32 that they rest with the rollers 64 supported in the outer roller supports 62, 67 on the outer lateral guide 32 of the center rail 30. Thus, the outer carriages 60, 65 are blocked on the center rail 30 in the direction of the surface normal of the lateral guides 32, 34 by the outer and inner roller supports 62, 63, 67, 68. In the direction of the acting gravitational force, they rest on the center rail 30 with the rollers 64 of the carriage base bodies 61, 66. The outer carriages 60, 65 can thus be moved easily along the center rail 30, and therefore in the extraction direction 3 of the drawer extraction guide, even under load. The carriages 60, 65 are blocked obliquely in respect to the extraction direction 3.

The transfer member 50 with its sliding members 54, 55 is placed on the support 33 of the center rail 30. The lateral bent elements 54.1, 55.1 enclosed the center rail 30 and rest on the outer lateral guide 32 of the center rail 30 shown in FIG. 5. The flat bottom side of the first toothed rack 52 rests on the support 33 of the center rail 30. The toothing of the first toothed rack 52 is open along the support 33 and obliquely in respect to the extraction direction 3 of the drawer extraction guide. It therefore lies in the plane of the third gearwheel 43 of the synchronization device 40. The first toothed rack 52 extends in the extraction direction 3 of the drawer extraction guide. In the shown assembled state, the insert 90 shown in FIG. 10 is not yet inserted into the rear recess 52.1 of the first toothed rack 52 provided for this purpose. The transfer member 50 is oriented in respect to the synchronization device 40 such that the third gearwheel 43 of the first wheel set 45 is arranged in the area of the rear recess 52.1. Hence, the third gearwheel 43 and therefore the first wheel set 45 are not yet coupled to the transfer member 50. The second toothed rack 53 arranged below the first toothed rack 52 is arranged beside the inner lateral guide 34 at the height of the gearwheel 44 shown in FIG. 4. The fourth gearwheel 44 therefore engages with the toothing of the second toothed rack 53. The sliding members 54, 55 are arranged at a distance to the carriage base bodies 61, 66 of the outer carriages 60, 65. The spacers 51.1 shown in FIG. 6 extend over the inner roller supports 63, 68 of the outer carriages 60, 65. The transfer member 50 is therefore movable obliquely in respect to the extraction direction 3 of the drawer extraction guide with the front and the rear sliding members 54, 55 along the center rail 30. The transfer member 50 and the carriages 60, 65 can therefore be moved independently from each other along the extraction direction 3 of the drawer extraction guide. FIG. 7 shows the fully extracted state of the partial assembly of the drawer extraction guide. The end face of the spacer 51.1 of the transfer member 50 rests on the sixth stop 36.4 which limits the inner lateral guide 34 of the center rail 30 to the front side. This notwithstanding, the front carriage base body 61 of the front outer carriage 60 rests on the seventh stop 36.5, which limits the support 33 of the center rail 30. The sixth stop 36.4 therefore limits the travel and sliding path of the transfer member 50 in the extraction direction 3 in respect to the center rail 30. The seventh stop 36.5 is a securing retainer for the outer carriage 60. The fifth stop 36.3 limits the movement of the transfer member 60 on the center rail 30 in the insertion direction. The fourth stop 36.2 forms a securing retainer for the rear outer carriage 65.

FIG. 8 shows a perspective view of the partially mounted drawer extraction guide with a drawer rail 70 arranged on it. The drawer rail 70 is pushed onto the center rail 30 from the back with the outer carriages 60, 65 and the transfer member 50 arranged thereon.

FIG. 9 shows a perspective view of the bottom of the drawer rail 70 shown in FIG. 8.

As FIG. 9 shows, a fourth toothed rack 79 is arranged in the area surrounded by the drawer rail 70 along its external surface 72. The fourth toothed rack 79 is connected to the external surface 72 of the drawer rail 70. It is made up of segments, in this case of three segments. The segments are connected to each other by means of connecting members 79.1, the last of which can be seen at the front end of the fourth toothed rack 79. The construction with toothed rack segments makes it possible to use the same segments to form the fourth toothed rack 79 on differently long drawer rails 70 of different drawer extraction guides.

When mounting the drawer rail 70 according to FIG. 8, the fourth toothed rack 79 engages in the toothing of the first gearwheel 41 (see FIG. 7) of the first wheel set 45, as shown in FIGS. 13 and 14. By means of a linear movement of the drawer rail 70 in or opposite to the extraction direction 3 of the drawer extraction guide, the engaging fourth toothed rack 79 turns the first gearwheel 41 and therefore also the second gearwheel 42 that sits on the same axle and is attached to the first gearwheel 41 in a torque proof manner. It meshes, as shown in FIG. 5, with the third gearwheel 43 so that this gearwheel is also turned when the drawer rail 70 is moved. By means of a linear movement of the drawer rail 70 in respect to the center rail 30, therefore, the gearwheels 41, 42, 43 associated with the first wheel set 45 are turned. When the drawer rail 70 is slid onto the center rail 30 during assembly, the inserts 90 shown in FIG. 10 are not yet inserted in the recesses 52.1, 52.3 intended therefore. The third gearwheel 43 of the first wheel set 45 therefore only meshes with the second gearwheel 42 and runs free on the opposite side. When the drawer rail 70 is slid onto the center rail 30, therefore, in spite of the engagement of the fourth toothed rack 79 with the first gearwheel 41 of the first wheel set 45, the rotational movement of the third gearwheel 43 is not transferred to the transfer member 50. The drawer rail 70 can therefore be moved to its correct position in respect to the center rail 30, the transfer member 50, and the outer carriages 60, 65.

FIG. 10 shows a perspective view of the insert 90 with its base body 92, the toothed rack section 91 formed on it, connecting pins 93.1, 93.2 at its end, the latching members 94, and the depression 95. The insert 90 is formed such that it can be inserted into the recesses 52.1, 52.3, as it is shown in FIG. 7 for the front recess 52.3. Thereby, the connecting pins 93.1, 93.2 engage in the respective recesses and the latching members 94 in the corresponding latching recesses 52.2, 52.4 at the transfer member 50 so that the insert 90 is safely retained. The depression 95 serves as an assembly aid to apply a tool during mounting and removing the insert 90, respectively. To this end, a screwdriver can be inserted into the depression 95, and therewith the latching members 94 can be levered out of the corresponding latching recesses 52.2, 52.4.

FIG. 11 shows a top view of a section of the partially assembled drawer extraction guide with the mounting opening 73.1 in the center rail 30 for mounting the insert 90 shown in FIG. 10. Starting from the assembly state shown in FIG. 8, the drawer rail 70 is moved so far in the extraction direction 3 that the mounting opening 73.1 is located opposite the rear recess 52.1 of the first toothed rack 52 of the transfer member 50. Now, the insert 90 can be placed in the rear recess 52.1 through the mounting opening 73.1, as shown in FIG. 11. Thereby, it latches with its latching members 94 into the rear latching recesses 52.2. The toothed rack section 91 of the insert 90 inserted into the rear recess 52.1 forms an extension of the first toothed rack 52 of the transfer member 50. The third gearwheel 43 of the first wheel set 45 engages in the toothing of the toothed rack section 91. Hereby, the first wheel set 45 forms a synchronized coupling between the drawer rail 70 and the transfer member 50. To this end, the first gearwheel 41 of the first wheel set 45 engages in the fourth toothed rack 79 of the drawer rail 70 and the third gearwheel 43 in the toothed rack section 91 or, respectively, if the drawer rail 70 is moved in respect to the center rail 30 in the first toothed rack 52 of the transfer member 50.

FIG. 12 shows a perspective view of the drawer extraction guide with the coupling 80 arranged thereon. The coupling 80 serves in a known manner to fasten the drawer rail 70 with a drawer attached thereto to the other assemblies of the drawer extraction guide attached to a furniture corpus. The coupling 80 serves to block the drawer extraction guide in its inserted position. By means of a handle 81, a coupling latch 83 guided in a coupling housing 82, with which the coupling 80 is held in the coupling receiver 78 of the drawer rail 70, can be moved such that it engages in a recess of a decor support 84 attached to the corpus rail 10. Then, the movement of the drawer extraction guide is blocked.

FIG. 13 shows the drawer extraction guide of FIG. 12 in a viewing direction along its longitudinal extension and in a sectional view. Thereby, the viewing direction is opposite to the extraction direction 3 of the drawer extraction guide.

The retaining section 11 of the corpus rail 10 can be attached to a wall of a furniture corpus, which is not shown. Then, the retaining section 11 is preferably vertically oriented. Facing the retaining section 11, the retraction member 2 and the damping member 1 covered by the retraction member 2 are attached along the retaining section 11 on the base 12 of the corpus rail 10. The corpus rail 10 with its lateral guide section 13 connected to the base 12 and with the support section 14 connected thereto, is guided in the middle region of the drawer extraction guide. The inner carriage 20 with its base part 21 and the first roller members 21.3 guided therein rests on the support section 14 of the corpus rail 10. Starting from the base part 21, its roller slides 23, 24, 25 encompass the lateral guide section 13 and the support section 14. The center rail 30 formed as a profile element encompasses the inner carriage 20 and the lateral guide section 13 and the support section 14 of the corpus rail 10. Thereby, the support 33 of the center rail 30 rests on the first roller members 21.3 of the front roller section 21.1 and on the hidden second roller members 21.4 of the rear roller section 21.2, as shown in FIG. 1. The inner carriage 20 therefore transfers a load from the support 33 of the center rail 30 to the support section 14 of the corpus rail 10, the load transmitted in the direction of the acting gravitational force by a drawer, which is not shown and mounted to the drawer extraction guide. The inner lateral guide 34 of the center rail 30 is positioned opposite the lateral guide section 13 of the corpus rail 10 such that it rests on the third roller member 23.1 of the front inner roller slide 23 and the fourth roller member 24.1 of the hidden front outer roller slide 25. Therefore, the third and fourth roller members 23.1, 24.1 roll on the lateral guide section 13 of the corpus rail 10 and on the inner lateral guide 34 of the center rail 30. On the opposite side of the lateral guide section 13, the outer roller slides 25, of which in the chosen perspective only the front outer roller slide 25 is visible, carry the fifth and sixth roller members 25.1, 25.2 which are arranged obliquely in respect to each other. Thereby, the fifth roller members 25.1 are oriented such that they roll on the lateral guide section 13 of the corpus rail 10 and on the outer lateral guide 32 of the center rail 30. The fifth roller members 25.1 are preferably horizontally oriented when the drawer extraction guide is mounted. The center rail 30 is guided laterally in respect to the corpus rail 10 by means of the third and fourth roller members 23.1, 24.1 of the inner roller slides 23, 24 and the fifth roller members 25.1 of the outer roller slide 25. The sixth roller members 25.2 are oriented such that they roll on the support section 14 of the corpus rail 10 and the height guiding member 31 of the center rail 30. The sixth roller members 25.2 are preferably vertically oriented when the drawer extraction guide is mounted. The center rail 30 is positioned on the support section 14 of the corpus rail 10 in a direction that is directed away from the base 12 of the corpus rail 10 and opposite to the gravitational force by means of the sixth roller member 25.2 arranged at the outer roller slides 25. The center rail 30 and the inner carriage 20 can therefore only be moved in respect to the corpus rail 10 along the extraction direction 3 of the drawer extraction guide. Obliquely in respect to the extraction direction 3, the inner carriage 20 and the center rail 30 are blocked in their movement by the corpus rail 10. The rolling support of the center rail 30 at the corpus rail 10 provoked by the inner carriage 20 allows for a smooth-running movement of the center rail 30 in respect to the corpus rail 10 in and opposite to the extraction direction 3 of the drawer extraction guide.

The drawer rail 70 encompass sections of the center rail 30 and of the transfer member 50 slidingly supported thereon. As shown in FIG. 15, the drawer rail 70 with its cover 73 is supported in a linearly movable manner on the support 33 of the center rail 30 by means of the outer carriages 60, 65. As can be seen in FIG. 13, the rotatably supported outer and inner track rollers 38.1, 38.2, which are supported by the outer lateral guide 32 and the inner lateral guide 34 of the center rail 30 in a rotatable manner, roll on the corresponding running surfaces 71, 75 of the drawer rail 70. This prevents the drawer rail 70 from being lifted off the center rail 30 against the acting gravitational force. The outer running surface 71 is furthermore guided on the roller 18 in a rolling manner, that is rotatably supported on the base 12 of the corpus rail 10 by means of the reel seat 17.

The transfer member 50 is arranged along the edge of the center rail 30 which is formed between the support 33 and the inner lateral guide 34. It rests on the support 33 with the bottom side of the first toothed rack 52 formed as a sliding surface. The lateral sliding rail 51 is in a sliding contact with the inside 74 of the drawer rail 70 by means of its external nubs 51.3. The transfer member 50 is thus guided obliquely in respect to the extraction direction 3, but, due to its slide bearing, can be easily moved along the extraction direction 3.

The first, second, and third gearwheel 41, 42, 43 of the first wheel set 45 are arranged above, and the fourth gearwheel 44 of the second wheel set 46 below the support 33 of the center rail 30. The fourth gearwheel 44 passes through a hidden opening through the inner lateral guide 34 of the center rail 30. It meshes with the third toothed rack 22 of the inner carriage 20 shown in FIG. 1 and on the opposing side with the second toothed rack 53 of the transfer member 50. The first gearwheel 41 of the first wheel set 45 meshes with the fourth toothed rack 79 arranged in the transition area between the cover 73 and the external surface 72 of the drawer rail 70. By means of a common axle, it is attached to the second gearwheel 42 in a torque proof manner, which meshes with the third gearwheel 43. The third gearwheel 43 engages in the first toothed rack 52 of the transfer member 50. The transfer member 50 thus forms a coupling between the first and the second wheel set 45, 46. In doing so, the first wheel set 45 creates a connection to the drawer rail 70 and the second wheel set 46 a connection to the inner carriage 20. By means of its rotatable support at the support 33 of the center rail 30, the gearwheels 41, 42, 43, 44 also form a connection to the center rail 30. The drawer rail 70, the center rail 30, and the inner carriage 20 are thus coupled in respect to each other in their movement along the extraction direction 3 by means of the synchronization device 40. Thereby, a predetermined synchronization between the movement of the drawer rail 70, the center rail 30, and the inner carriage 20 is achieved through the transmission of the wheel sets 45, 46.

FIG. 14 shows a section of the drawer extraction guide of FIG. 12 in a bottom sectional view with components of the synchronization device 40 shown in FIG. 4. To better illustrate the interaction of the components of the synchronization device 40, the center rail 30 is not shown. The insert 90 is inserted in the rear recess 52.1 at the first toothed rack 52 of the transfer member 50. The third gearwheel 43 meshes with the first toothed rack 52 of the transfer member 50 and in its extension with the toothed rack section 91 of the insert 90. On the opposite side, the third gearwheel 43 meshes with the second gearwheel 42 that is attached in a torque proof manner to the same axle as the first gearwheel 41. The first gearwheel 41 meshes with the fourth toothed rack 79, which is connected to the drawer rail 70. The fourth gearwheel 44 meshes with the second toothed rack 53 of the transfer member 50, which is covered by the inner running surface 75 of the drawer rail 70.

The transfer member 50 and the outer carriages 60, 65 are spaced apart from each other and can be moved independently from each other without them interacting with each other.

FIG. 15 shows the drawer extraction guide of FIG. 12 in a viewing direction along its longitudinal extension. Compared to the illustration in FIG. 13, the drawer extraction guide is not shown in a sectional view. This way, the front outer carriage 60 with its front carriage base body 61, its front outer roller support 62 formed thereon at an angle, and arranged opposite thereto its front inner roller support 63, can be seen between the center rail 30 and the drawer rail 70. The front carriage base body 61 is arranged between the support 33 of the center rail 30 and the cover 73 of the drawer rail 70. The rollers 64 held therein roll on the support 33 and the cover 73. Thus, forces introduced by the drawer rail 70 are transferred to the center rail 30. Between the outer lateral guide 32 of the center rail 30 and the external surface 72 of the drawer rail 70, the front outer roller support 62 is arranged such that the rollers 64 positioned therein roll on the outer lateral guide 32 and, on the opposite side, on the external surface 72 of the drawer rail 70. The front inner roller support 63 is located between the inner lateral guide 34 of the center rail 30 and the internal surface 74 of the drawer rail 70. The rollers 64 supported therein roll on the inner lateral guide 34 and, on the opposite side, on the internal surface 74 of the drawer rail 70. The rear outer carriage 65, which is hidden in the chosen perspective, is located, in the and opposite to the extraction direction 3, spaced apart from the front outer carriage 60 and between the drawer rail 70 and the center rail 30. The outer carriages 60, 65 thus form a support of the drawer rail 70 in respect to the center rail 30 that is smooth-running and that can be moved in the and opposite to the extraction direction 3 and that is blocked in the oblique direction thereto.

The drawer stop 76 serves as an arrester hook for the drawer and protrudes from the cover 73 of the drawer rail 70. A rear side of a drawer that is not shown is fastened thereto. The first stop 15 arranged at the end of the lateral guide section 13 of the corpus rail 10 is inserted into the travel path of the front inner rolling side 23 of the inner carriage 20. It limits the travel path of the inner carriage 20 in the extraction direction 3.

FIG. 16 shows a section of the drawer extraction guide of FIG. 12 in a perspective view with stops 76, 77.1, 77.2 arranged at the center rail 30. In the operating position shown, the assembled drawer extraction guide is fully extracted. Accordingly, the center rail 30 is moved at its maximum in respect to the corpus rail 10, and the drawer rail 70 at its maximum in respect to the center rail 30. As FIG. 16 shows, in this end position the rear outer carriage 65 abuts with its rear termination of its rear carriage base body 66 against the ninth stop 77.1. The rear lateral sliding rail 51 of the transfer member 50 abuts against the tenth stop 77.2. The positions of the rear outer carriage 65 and of the transfer member 50 are therefore defined by the ninth stop 77.1 and the tenth stop 77.2 when the drawer extraction guide is fully extracted. Should the outer carriage 65 or the transfer member 50 adjust incorrectly during the use of the drawer extraction guide, its correct position is readjusted again by the ninth stop 77.1 and the tenth stop 77.2 when the drawer extraction guide is completely opened.

FIG. 17 shows the front end of the center rail 30 in a perspective view. The corpus rail 10 and the drawer rail 70 as well as the inner carriage 20 are not shown to make the figure easier to understand. The representation shows the position of the front outer carriage 60 and of the front area of the transfer member 50 when the drawer extraction guide is completely pushed in. In this position, the front outer carriage 60 abuts with its front carriage base body 61 against the seventh stop 36.5, which rises above its support 33 at the front end of the center rail 30. The front end of the lateral sliding rail 51 of the transfer member 50 abuts against the sixth stop 36.4 of the center rail 30. Thereby, the sixth stop 36.4 laterally protrudes over its inner lateral guide 34 at the front end of the center rail 30. The positions of the front outer carriage 60 and of the transfer member 50 are therefore, when the drawer extraction guide is completely pushed in, defined by the sixth stop 36.4 and the seventh stop 36.5. If during operation of the drawer extraction guide the position of the front outer carriage 60 or of the transfer member 50 should be misplaced in respect to their intended position, their desired position is readjusted again by the sixth stop 36.4 and the seventh stop 36.5 when the drawer extraction guide is pushed together.

FIG. 18 shows a block diagram of components of the drawer extraction guide and their cause and effect relationships. Thereby, the components are realized as rectangles or circles and the rolling and the meshing connections, respectively, are realized as connection lines.

The drawer rail 70 is movably supported a linear direction on the center rail 30 by means of the front and the rear outer carriages 60, 65, with rollers 64. The center rail 30 is, in turn, movably supported in a linear direction on the corpus rail 10 by means of roller members 21.3, 21.4, 23.1, 24.1, 25.1, 25.2 of the inner carriage 20. The outer carriages 60, 65 comprise the rollers 64 shown in FIG. 1, which roll at the drawer rail 70 and at the center rail 30. Due to the friction of the rollers 64 on the center rail 30 and the drawer rail 70, a preset motion sequence results between the drawer rail 70, the outer carriages 60, 65, and the center rail 30 when the drawer extraction guide is pulled out and pushed in. The roller members 21.3, 21.4, 23.1, 24.1, 25.1, 25.2 of the inner carriage 20 shown in FIG. 1 and FIG. 13, respectively, roll on the center rail 30 and the corpus rail 10. Here as well, due to the frictional contact of the roller members 21.3, 21.4, 23.1, 24.1, 25.1, 25.2 in respect to the center rail 30 and the corpus rail 10, a preset motion sequence results between the center rail 30 and the inner carriage 20 in respect to the corpus rail 10 attached to the piece of furniture. Without a synchronization device 40, depending on the present frictional conditions, first the rails between which the lowest friction occurs would be pulled apart when the drawer extraction guide is extracted. First, for example, the drawer rail 70 would be moved in respect to the center rail 30, and only once the drawer rail 70 is fully extracted in respect to the center rail 30 would the center rail 30 be moved in respect to the corpus rail 10. The synchronization device 40 with the first and the second wheel set 45, 46 and the transfer member 50 creates a fixed coupling between the movement of the drawer rail 70, the center rail 30, and the inner carriage 20. To this end, the first wheel set 45 is coupled with the drawer rail 70 by means of the first gearwheel 41. During a movement of the drawer rail 70 in respect to the center rail 30, the first gearwheel 41, the second gearwheel 42, and the third gearwheel 43 of the first wheel set 45 are rotated. The transfer member 50 transfers this movement to the fourth gearwheel 44 of the second wheel set 46. This gear wheel is coupled with the inner carriage 20. Preferably, the transmission ratios of the wheel sets 45, 46 are selected such that, starting from the drawer rail 70, to the outer carriages 60, 65, the center rail 30, and ending at the inner carriage 20, a motion speed and therefore travel path gradually decreasing towards the corpus rail 10 occurs when the drawer extraction guide is pulled out or pushed in. A preferred synchronization is selected such that when the drawer extraction guide is pulled out, the outer carriages 60, 65 travel three quarters of the travel path of the drawer rail 70, that the center rail 30 travels half the travel path of the drawer rail 70, and that the inner carriage 20 travels one fourth of the travel path of the drawer rail 70 in respect to the corpus rail 10. It is feasible, however, to achieve other ratios of the travel paths performed by the movable parts by means of other transmission ratios of the synchronization device 40. In both cases, it is important to note that the movement of the rails and carriages 20, 60, 65 dictated by the synchronization device 40 matches the movement dictated by the rollers 64 and the roller members 21.3, 21.4, 23.1, 24.1, 25.1, 25.2 of the inner and outer carriages 20, 60, 65.

By means of the track rollers 38.1, 38.2, an additional coupling is achieved between the drawer rail 70 and the center rail 30. Accordingly, the roller 18 effects a coupling between the drawer rail 70 and the corpus rail 10. The track rollers 38.1, 38.2 as well as the roller 18 serve to vertically support the respective rails. Regarding the synchronization of the movement of the rails and the carriages 20, 60, 65, the track rollers 38.1, 38.2 and the roller 18 are optional and are therefore represented as dotted lines.

The invention claimed is:

1. A drawer extraction guide for supporting a drawer to be linearly movable along an extraction direction relative to a furniture body, the drawer extraction guide comprising:

a body rail configured to be attached to the furniture body;

a drawer rail configured to be attached to the drawer;

a center rail configured to be linearly movable and to transmit force between the body rail and the drawer rail;

at least one load-transmitting inner carriage arranged between the body rail and the center rail;

at least one load-transmitting outer carriage arranged between the center rail and the drawer rail; and a synchronization device configured to synchronize a movement of the center rail with a movement of the drawer rail, the synchronization device including:

a first wheel set including at least one synchronization wheel, wherein a synchronization wheel of the first wheel set rolls on one of the rails, or on a component attached to one of the rails, or on one of the carriages, or on a component attached to one of the carriages;

a second wheel set coupled to the first wheel set, the second wheel set including at least synchronization wheel, wherein a synchronization wheel of the second wheel set rolls on a further one of the rails, or on a component attached to the further one of the rails, or on a further one of the carriages, or on a component attached to the further one of the carriages;

a transfer member linearly movable with respect to the body rail, the center rail, the drawer rail, and the first and second wheel sets; and wherein a synchronization wheel of each of the first and second wheel sets rolls on the transfer member.

2. The drawer extraction guide of claim 1, wherein:

the transfer member is supported so as to be linearly movable relative to the body rail in the extraction direction and in a retraction direction opposite to the extraction direction.

3. The drawer extraction guide of claim 1, wherein:

at least one of the first and second wheel sets includes two or more synchronization wheels coupled with each other.

4. The drawer extraction guide of claim 1, wherein:

each of the synchronization wheels is formed at least partially as a toothed gearwheel.

5. The drawer extraction guide of claim 1, wherein:

the synchronization wheels are rotatably supported from the center rail.

6. The drawer extraction guide of claim 5, wherein:

the center rail includes a support configured to receive a load of a drawer connectible to the drawer extraction guide; and each of the synchronization wheels includes an axle oriented normal to the support.

7. The drawer extraction guide of claim 1, wherein:

the transfer member includes at least a first toothed rack and a second toothed rack extending longitudinally along the transfer member, each of the racks including toothing directed in the same direction; and a synchronization wheel of the first wheel set meshes with the first toothed rack and a synchronization wheel of the second wheel set meshes with the second toothed rack.

8. The drawer extraction guide of claim 7, wherein:

at least one of the first and second toothed racks includes one or more recesses and one or more inserts placeable in the one or more recesses such that a toothed rack section of the respective insert closes a gap in the respective toothed rack formed by the respective recess.

9. The drawer extraction guide of claim 1, wherein:

the transfer member is supported on at least one of the center rail, the drawer rail and the body rail such that the transfer member is slideable parallel to the extraction direction relative to the supporting rail and such that movement of the transfer member obliquely relative to the extraction direction is blocked.

10. The drawer extraction guide of claim 1, wherein:

the at least one load-transmitting outer carriage includes first and second outer carriages; and the transfer member is positioned between the first and second outer carriages.

11. The drawer extraction guide of claim 1, wherein:

a movement range of the transfer member in the extraction direction is limited by a stop arranged at a front end of the center rail; and a movement range of the transfer member in a retraction direction is limited by a stop arranged on the drawer rail.

12. A drawer extraction guide for supporting a drawer to be linearly movable along an extraction direction relative to a furniture body, the drawer extraction guide comprising:

a body rail configured to be attached to the furniture body;

a drawer rail configured to be attached to the drawer;

a center rail configured to be linearly movable and to transmit force between the body rail and the drawer rail;

at least one load-transmitting inner carriage arranged between the body rail and the center rail;

at least one load-transmitting outer carriage arranged between the center rail and the drawer rail; and a synchronization device configured to synchronize a movement of the center rail with a movement of the drawer rail, the synchronization device including:

a first wheel set including at least one synchronization wheel, wherein a synchronization wheel of the first wheel set engages a toothed rack of the drawer rail;

a second wheel set coupled to the first wheel set, the second wheel set including at least one synchronization wheel, wherein a synchronization wheel of the second wheel set engages a toothed rack of the at least one load-transmitting inner carriage;

a transfer member linearly movable with respect to the body rail, the center rail and the drawer rail, the transfer member including first and second toothed racks; and wherein a synchronization wheel of the first wheel set engages the first toothed rack of the transfer member and a synchronization wheel of the second wheel set engages the second toothed rack of the transfer member.

13. The drawer extraction guide of claim 12, wherein:

at least one of the first and second wheel sets includes two or more synchronization wheels coupled with each other.

14. The drawer extraction guide of claim 12, wherein:

each of the synchronization wheels is formed at least partially as a toothed gearwheel rotatably supported from the center rail.

15. The drawer extraction guide of claim 14, wherein:

the center rail includes a support configured to receive a load of a drawer connectible to the drawer extraction guide; and each of the synchronization wheels includes an axle oriented normal to the support.

16. The drawer extraction guide of claim 12, wherein:

at least one of the first and second toothed racks of the transfer member includes one or more recesses and one or more inserts placeable in the one or more recesses such that a toothed rack section of the respective insert closes a gap in the respective toothed rack formed by the respective recess.

17. The drawer extraction guide of claim 12, wherein:

the transfer member is supported on the center rail such that the transfer member is slideable parallel to the extraction direction relative to the center rail and such that movement of the transfer member obliquely relative to the extraction direction is blocked.

18. The drawer extraction guide of claim 12, wherein:

the at least one load-transmitting outer carriage includes first and second outer carriages; and the transfer member is positioned between the first and second outer carriages.

19. The drawer extraction guide of claim 12, wherein:

a movement range of the transfer member in the extraction direction is limited by a stop arranged at a front end of the center rail; and a movement range of the transfer member in a retraction direction is limited by a stop arranged on the drawer rail.

* * * * *